US007438473B2

(12) United States Patent
Borchardt

(10) Patent No.: US 7,438,473 B2
(45) Date of Patent: Oct. 21, 2008

(54) FLEXIBLE STORAGE BAG

(75) Inventor: Michael G. Borchardt, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 11/380,607

(22) Filed: Apr. 27, 2006

(65) Prior Publication Data

US 2006/0182371 A1 Aug. 17, 2006

Related U.S. Application Data

(63) Continuation-in-part of application No. 10/880,784, filed on Jun. 29, 2004.

(51) Int. Cl.
*B65D 33/01* (2006.01)

(52) U.S. Cl. ..... 383/103; 383/44; 383/100

(58) Field of Classification Search ..... 383/100, 383/103, 63, 44; 53/405
See application file for complete search history.

(56) References Cited

U.S. PATENT DOCUMENTS

| | | | | |
|---|---|---|---|---|
| 2,576,322 | A | 11/1951 | Waters | |
| 2,649,234 | A | 8/1953 | Taunton | |
| 2,778,171 | A * | 1/1957 | Taunton | 53/405 |
| 2,778,173 | A * | 1/1957 | Taunton | 53/427 |
| 2,870,954 | A | 1/1959 | Kulesza | |
| 3,762,404 | A | 10/1973 | Sakita | |
| 3,799,427 | A | 3/1974 | Goglio | |
| 3,980,226 | A | 9/1976 | Franz | |
| 4,295,566 | A | 10/1981 | Vincek | |
| 4,310,118 | A | 1/1982 | Kisida et al. | |
| 4,702,376 | A | 10/1987 | Pagliaro | |
| 4,715,494 | A | 12/1987 | Heitzenrioder et al. | |
| 4,756,422 | A | 7/1988 | Kristen | |
| 5,142,970 | A | 9/1992 | ErkenBrack | |
| 5,228,271 | A | 7/1993 | Wallace | |
| 5,332,095 | A | 7/1994 | Wu | |
| RE34,929 | E | 5/1995 | Kristen | |
| 5,450,963 | A * | 9/1995 | Carson | 206/524.8 |
| 5,480,030 | A | 1/1996 | Sweeney et al. | |
| 5,544,752 | A | 8/1996 | Cox | |
| 5,584,409 | A | 12/1996 | Chemberlen | |
| 5,881,881 | A | 3/1999 | Carrington | |

(Continued)

FOREIGN PATENT DOCUMENTS

| | | | |
|---|---|---|---|
| JP | 01279073 | A | 11/1989 |

(Continued)

*Primary Examiner*—Nathan J Newhouse
*Assistant Examiner*—Jack H Morgan, Jr.
(74) *Attorney, Agent, or Firm*—Thomas C. Feix

(57) ABSTRACT

The flexible storage bag includes overlaying first and second sidewalls defining an internal volume that can be accessed from an open top edge. To evacuate air from the internal volume after the open top edge has been closed, the bag includes a one-way valve element attached to the first sidewall and communicating with the internal volume. To prevent the one-way valve element from becoming clogged by the opposing second sidewall, the bag also includes a textured portion that maintains at least a partial clearance between the first and second sidewalls proximate the valve element. To prevent contamination of the valve element, the textured portion can also be configured to facilitate removal of liquids and juices from air exhausting from the storage bag.

15 Claims, 33 Drawing Sheets

U.S. PATENT DOCUMENTS

| | | | | |
|---|---|---|---|---|
| 5,931,189 | A * | 8/1999 | Sweeney et al. | 137/512.15 |
| 5,996,800 | A | 12/1999 | Pratt | |
| 6,021,624 | A | 2/2000 | Richison et al. | |
| 6,039,182 | A | 3/2000 | Light | |
| 6,059,457 | A * | 5/2000 | Sprehe et al. | 383/63 |
| 6,070,397 | A | 6/2000 | Bachhuber | |
| 6,357,915 | B2 | 3/2002 | Anderson | |
| 6,575,191 | B2 | 6/2003 | Skeens et al. | |
| 6,581,641 | B2 | 6/2003 | Skeens et al. | |
| 6,604,634 | B2 | 8/2003 | Su | |
| 6,715,644 | B2 | 4/2004 | Wilford | |
| 6,799,680 | B2 | 10/2004 | Mak | |
| 6,932,509 | B2 | 8/2005 | Shah et al. | |
| 2003/0024847 | A1 | 2/2003 | Malaspina | |
| 2003/0102245 | A1 | 6/2003 | Wang | |
| 2003/0136798 | A1 * | 7/2003 | Wilford | 222/107 |
| 2003/0155269 | A1 | 8/2003 | Lee | |
| 2004/0000501 | A1 | 1/2004 | Shah et al. | |
| 2004/0000502 | A1 | 1/2004 | Shah et al. | |
| 2004/0000503 | A1 | 1/2004 | Shah et al. | |
| 2004/0007494 | A1 | 1/2004 | Popeil et al. | |
| 2004/0050745 | A1 | 3/2004 | Lee et al. | |
| 2004/0223667 | A1 * | 11/2004 | Shah et al. | 383/103 |
| 2005/0025396 | A1 | 2/2005 | ErkenBrack | |
| 2005/0036718 | A1 | 2/2005 | Wu et al. | |
| 2005/0065007 | A1 | 3/2005 | Wu et al. | |
| 2005/0172577 | A1 | 8/2005 | Oltrogge | |
| 2005/0205455 | A1 | 9/2005 | Harrison | |

FOREIGN PATENT DOCUMENTS

| | | |
|---|---|---|
| JP | 03212355 A | 9/1991 |
| WO | WO 2004/002840 | 1/2004 |
| WO | WO 2004/002841 | 1/2004 |
| WO | WO2004/002850 | 1/2004 |
| WO | WO 2005/000706 | 1/2005 |
| WO | WO 2005/016774 | 2/2005 |
| WO | WO 2005/040005 | 5/2005 |

* cited by examiner

FIG. 2
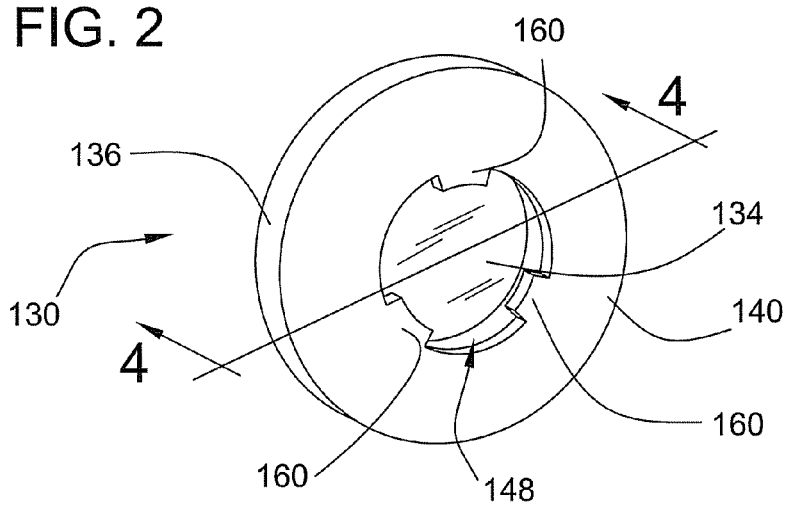
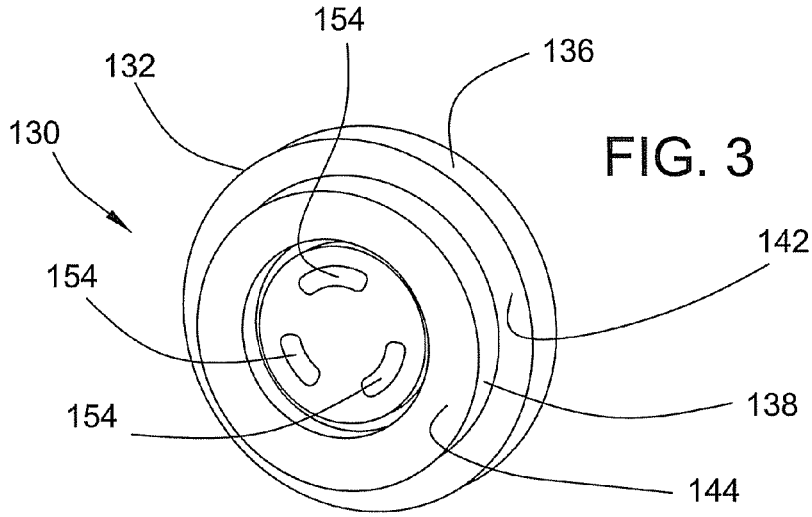
FIG. 3
FIG. 4
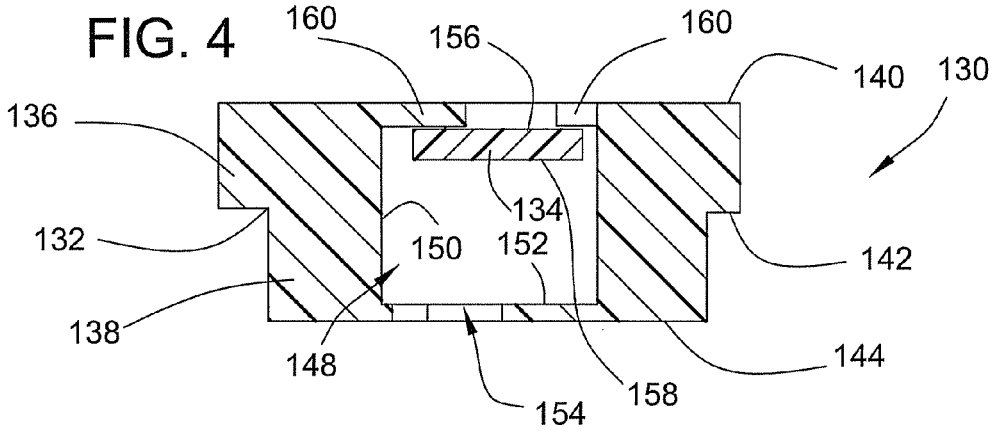

FLEXIBLE STORAGE BAG

CROSS-REFERENCE TO RELATED APPLICATIONS

This patent application is a continuation-in-part of copending U.S. patent application Ser. No. 10/880,784, filed on Jun. 29, 2004.

FIELD OF THE INVENTION

This invention pertains generally to storage containers and more particularly to flexible storage bags designed to be sealed and evacuated. The invention finds particular applicability in the field of food storage.

BACKGROUND OF THE INVENTION

Flexible plastic bags are widely used for a variety of purposes such as storing food items, either temporarily as in the case of packaging snacks or long term as in the case of freezer storage. Plastic bags of this style typically include flexible sidewalls made from, for example, polyethylene, that define an opening and an internal volume accessible through the opening. To seal the bag, interlocking closure strips may be provided about the rim of the opening.

One common problem which occurs with such bags is that, after the opening has been sealed, latent air may remain trapped in the internal volume. In addition to undesirably increasing the overall size of the sealed bag, the trapped air can cause spoilation of food items stored in the internal volume. Therefore, a one-way valve element may be attached to a flexible sidewall and communicating with the internal volume. The one-way valve element allows for the evacuation of the trapped air from the internal volume while also preventing the ingress of air from the surrounding environment into the internal volume. The one-way valve element may be activated in various ways such as, for example, by applying compressive pressure to the flexible sidewalls to force air from the internal volume or by engaging a nozzle of a vacuum source to the one-way valve element to draw air from the internal volume. An example of a one-way valve element that operates in conjunction with a vacuum source is provided in U.S. Pat. No. 6,581,641.

A problem that may arise with such bags that include one-way valve elements is that, during evacuation, the flexible sidewall may collapse against itself, against the contents of the bag, or against the valve element thereby preventing air from accessing the valve element. Another problem is that contents of the stored food items may contain fluids or juices that, during evacuation, may be drawn into and thereby contaminate the valve element. As will be appreciated, the contaminated valve element may result in sanitary issues and may not function properly. These and other problems are remedied by the invention described herein.

BRIEF SUMMARY OF THE INVENTION

The invention provides a storage bag made from a flexible sidewall configured to provide an interior volume for receiving and holding items. To evacuate the interior volume, a one-way valve element is attached to the flexible sidewall and communicates with the interior volume. To facilitate evacuation of the interior volume via the valve element, the storage bag includes a textured portion on the inner surface of the sidewall. The textured portion can be formed as a plurality of peaks or protuberances, a plurality of grooves and ridges, or as another structure raised from the inner surface of the sidewall that provides recessed passageways along the inner surface. In operation, as the sidewall collapses upon itself or upon the bag's contents during evacuation, air in the interior volume may continue to be directed via the passageways to the one-way valve element.

In accordance with an aspect of the invention, the textured portion can be configured to remove some of the fluids and juices that may be entrained in the evacuating air. To accomplish this, the textured portion is structured so that the volume of passageways proximate the valve element is less than the volume of passageways that are spaced further from the valve element. For example, the textured portion can be provided as a distinct first textured portion proximate the valve element and a second textured portion spaced apart from the valve element, wherein the aggregate volumetric capacity of the passageways of the first portion per unit area of first textured portion is less than the aggregate volumetric capacity of passageways of the second portion per equivalent unit area of the second textured portion. An advantage of reducing the volume of the passageway proximate the valve element is that evacuating air experiences a correlating increase in pressure. The increased pressure causes the entrained liquids to condense or drop out of the air prior to accessing the valve element. Decreasing the volumetric capacity of the passageways can be accomplished in any number of suitable different ways including changing the height of the protuberances, changing the width or depth of the grooves, or the changing the number or frequency of the passageways proximate the valve element.

Thus, an advantage of the invention is that it assists in preventing a one-way valve element from becoming clogged with an opposing flexible sidewall. Another advantage is that the invention provides a storage bag configured to prevent contamination of a one-way valve element by separating fluids from evacuating air. These and other advantages and features of the invention will become apparent from the detailed description and the accompanying drawings.

The invention may also include a clearance member for preventing the opposing second sidewall from clogging the one-way valve element while maintaining communication between the valve element and the internal volume. The clearance member additionally hinders the collapsing together of the first and second sidewalls that results in trapping of air in other portions of the internal volume.

In one aspect, the clearance member is provided as a textured portion on an inner surface of the sidewall that is opposite the valve element. The textured portion provides various evacuation passages that are recessed into the opposing sidewall. Accordingly, even when the second sidewall and the valve element collapse adjacent to each other, the evacuation passages communicate with an inlet to the valve element allowing for continued evacuation. In another aspect, the clearance member can be a permeable element attached to the inner surface of the first sidewall to cover the valve element. Accordingly, the second sidewall is prevented from collapsing adjacent to the valve element by the permeable element. The permeable element, however, is comprised of a material that demonstrates high air permeability so that air can continue to access the covered valve element.

In another aspect, the clearance member is provided as a rigid structure attached to the valve element or to the sidewalls proximate to the valve element. The rigid structure spaces the opposing sidewalls apart from each other thereby allowing for continued evacuation. In yet another aspect, the clearance member may be a compressible structure attached to the valve element or sidewalls. While the compressible structure continues to prevent the complete collapsing together of the sidewalls, it also compresses to minimize the space between the sidewalls and, accordingly, minimizes the air remaining in the internal volume.

BRIEF DESCRIPTION OF THE DRAWINGS

FIG. 2 is a front perspective view of an embodiment of a one-way valve element for attachment to the flexible bag of FIG. 1.

FIG. 3 is a rear perspective view of the one-way valve element of FIG. 2.

FIG. 4 is a cross-sectional view through the one-way valve element, as taken along line of FIG. 2.

DETAILED DESCRIPTION OF THE INVENTION

Figure 1:
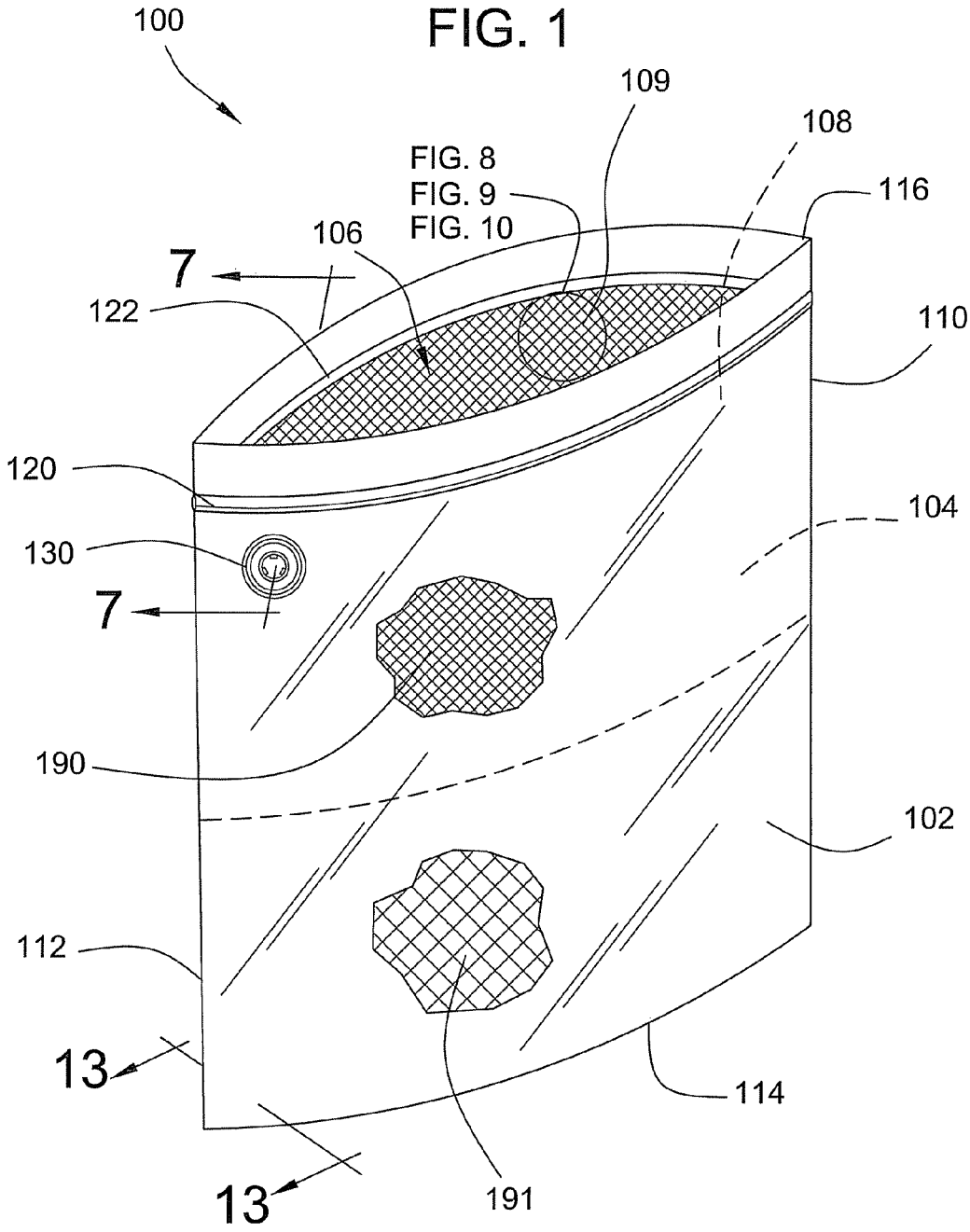
FIG. 1 is a perspective view of a flexible bag designed in accordance with the teachings of the invention having an open top, an attached one-way valve element, and a first portion and a second portion illustrated in cutaway.

Now referring to the drawings, wherein like reference numbers refer to like elements, there is illustrated in FIG. 1 an flexible bag 100 designed in accordance with the teachings of the invention. In the illustrated embodiment, the flexible bag 100 includes a first sidewall 102 and an opposing second sidewall 104 overlaying the first sidewall 102 to define an internal volume 106. Accordingly, the first and second sidewall 102, 104 each includes a respective first inner surface 108 and an opposing second inner surface 109. The first and second sidewalls 102, 104 can be made from flexible webs of thermoplastic material such as, for example, polyethylene.

The webs may be monolayer or multilayer film typically used for food storage. Multilayer films may be laminations or coextrusions. Resins may include polyethylene including high density (HDPE), low density (LDPE), linear low (LLDPE), nylon, ethylene vinyl alcohol (EVOH), polypropylene (PP), ethylene vinyl acetate (EVA), polyester, ionomers or metallized films. Examples of coextruded multilayer film suitable for the current invention include layered combinations such as HDPE/tie-layer/EVOH/tie-layer/LDPE or nylon/tie-layer/LDPE. For heat sealing, the sealant may be a blend of materials such that when the bag is opened the peel does not result in destruction of the bag. One such sealant material would consist of a blend of LDPE and polybutene-1 commonly referred to as a peel-seal resin whereby polybutene-1 is the minor phase.

The first and second sidewalls 102, 104 are sealed together along a first side edge 110, a parallel second side edge 112, and a closed bottom edge 114 that extend perpendicularly between the first and second side edges. To access the internal volume 106, the portions of the first and second sidewalls 102, 104 extending along an open top edge 116 remain unsealed. Due to the four orthogonal edges, the flexible bag 100 has a generally rectangular shape. However, it will be appreciated that in other embodiments, the bag can have any suitable shape resulting from any number of sidewalls and edges.

To releasably close the opened top edge 116 after insertion of an item for storage, there is attached to first and second sidewalls 102, 104 and parallel to the open top edge respective first and second fastening strips 120, 122. The first and second fastening strips 120, 122 can be formed from extruded, flexible thermoplastic and extend between the first and second side edges 110, 112. As will be appreciated by those of skill in the art, the first and second fastening strips 120, 122 can engage to form a seal which closes the normally open top edge 116. Of course, in other embodiments or in combination with the interlocking strips, other methods such as the use of pressure sensitive or cold seal adhesives such as those disclosed in U.S. Pat. No. 6,149,304, herein incorporated by reference in its entirety, heat-sealing, or cling can be employed to seal the open top edge.

To evacuate air trapped in the flexible bag 100 after sealing the open top edge 116, the bag includes a one-way valve element 130 that is attached to the first sidewall 102 and communicates with the internal volume 106. The one-way valve element 130 is capable of opening to allow entrapped air from the internal volume 106 to escape and closing to prevent to the ingress of environmental air into the internal volume. Communication with the internal volume 106 can be accomplished by disposing an opening through the first sidewall 102 and then attaching the valve element 130 over the opening.

Referring to FIGS. 2, 3, and 4, in an embodiment, the one-way valve element 130 can include a rigid valve body 132 that cooperates with a movable disk 134 to open and close the valve element. The valve body 132 includes a circular flange portion 136 extending between parallel first and second flange faces 140, 142. Concentric to the flange portion and projecting from the second flange face 142 is a circular boss portion 138 which terminates in a planar boss face 144 that is parallel to the first and second flange faces. The circular boss portion 138 is smaller in diameter than the flange portion 136 so that the outermost annular rim of the second flange face 142 remains exposed. The valve body 132 can be made from any suitable material such as a moldable thermoplastic material like nylon, HDPE, high impact polystyrene (HIPS), polycarbonates (PC), and the like.

Disposed concentrically into the valve body 132 is a counter-bore 148. The counter-bore extends from the first flange face 140 part way towards the boss face 144. The counter-bore 148 defines a cylindrical bore wall 150. Because it extends only part way toward the boss face 144, the counter-bore 148 forms within the valve body 132 a preferably planar valve seat 152. To establish fluid communication across the valve body, there is disposed through the valve seat 152 at least one aperture 154. In fact, in the illustrated embodiment, a plurality of apertures 154 are arranged concentrically and spaced inwardly from the cylindrical bore wall 150.

To cooperatively accommodate the movable disk 134, the disk is inserted into the counter-bore 148. Accordingly, the disk 134 is preferably smaller in diameter than the counter-bore 148 and has a thickness as measured between a first disk face 156 and a second disk face 158 that is substantially less than the length of the counter-bore 148 between the first flange face 140 and the valve seat 152. To retain the disk 134 within the counter-bore 148, there is formed proximate to the first flange face 140 a plurality of radially inward extending fingers 160. The disk 134 can be made from any suitable material such, as for example, a resilient elastomer.

Referring to FIG. 4, when the disk 134 within the counter-bore 148 is moved adjacent to the fingers 160, the valve element 130 is in its open configuration allowing air to communicate between the first flange face 140 and the boss face 144. However, when the disk 134 is adjacent the valve seat 152 thereby covering the apertures 154, the valve element 130 is in its closed configuration. To assist in sealing the disk 134 over the apertures 154, a sealing liquid can be applied to the valve seat 152. Furthermore, a foam or other resilient member may be placed in the counter-bore 148 to provide a tight fit of the disk 134 and the valve seat 152 in the closed position.

Referring to FIG. 1, to establish the one-way aspect of the valve element 130, the valve element is attached to the first sidewall 102 with the apertures exposed to the internal volume 106 and the first flange face exposed on the exterior of the flexible bag 100. Accordingly, referring to FIGS. 1 and 4, it will be appreciated that evacuation of entrapped air will move the disk 134 adjacent the fingers 160 thereby configuring the valve element 130 as opened while the ingress of air from the environment will move the disk adjacent the valve seat 152 thereby configuring the valve element as closed.

To attach the valve element 130 to the first sidewall, referring to FIG. 3, an adhesive can be applied to the exposed annular rim portion of the second flange face 142. The valve element 130 can then be placed adjacent the exterior surface of the first sidewall with the boss portion 138 being received through the hole disposed into the sidewall and thereby pass into the internal volume. Of course, in other embodiments, adhesive can be placed on other portions of the valve element, such as the first flange face, prior to attachment to the sidewall.

Figure 5:
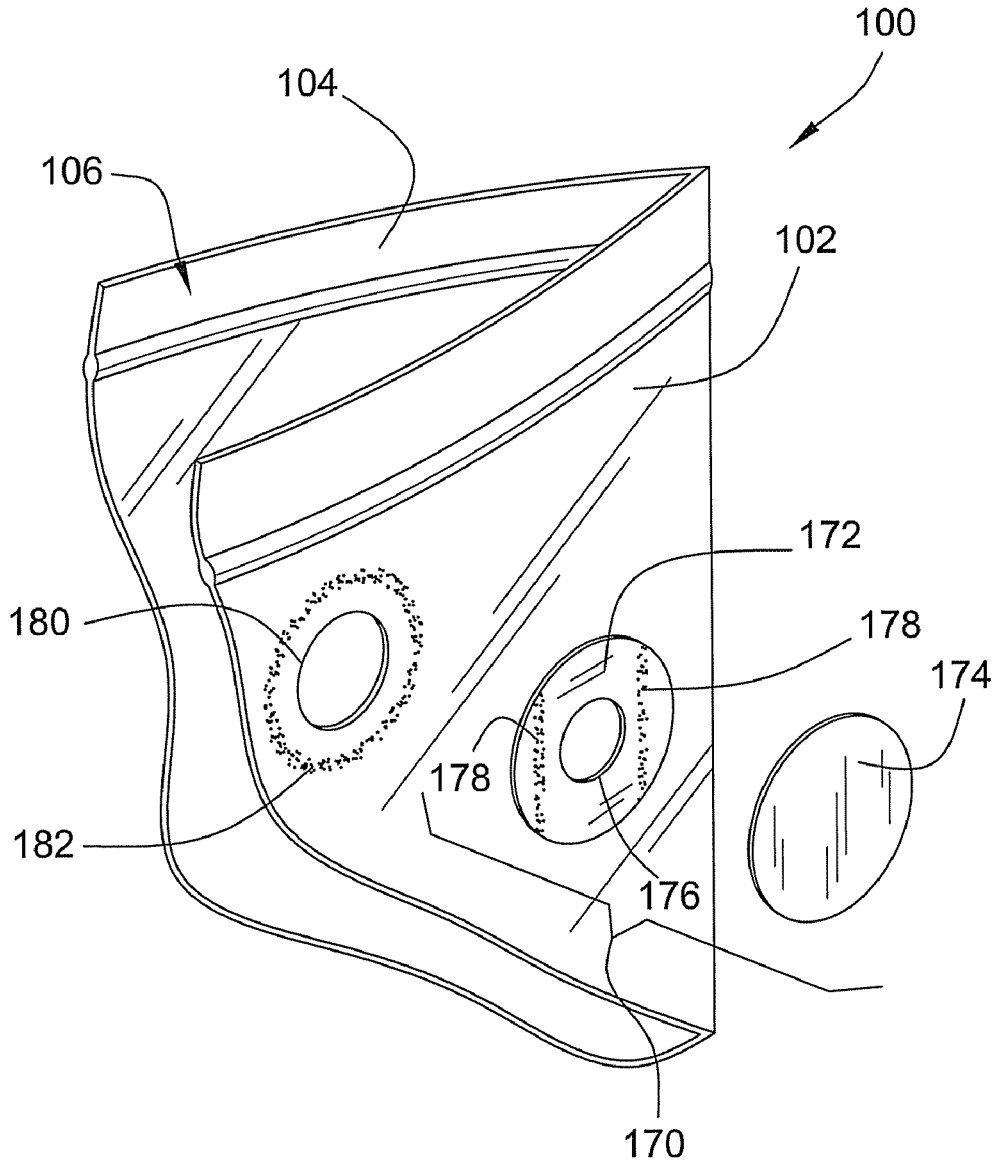
FIG. 5 is an exploded view of another embodiment of the one-way valve element for attachment to the flexible bag.

In other embodiments, the one-way valve element can have a different construction. For example, as illustrated in FIG. 5, the one-way valve element 170 can include a flexible, circular base layer 172 that cooperates with a correspondingly circular shaped, resilient top layer 174 to open and close the valve element. The top and bottom layers can be made from any suitable material such as, for example, a flexible thermoplastic film. Disposed through the center of the base layer 172 is an aperture 176, thus providing the base layer with an annular shape. The top layer 174 is placed over and adhered to the base layer 172 by two parallel strips of adhesive 178 that extend along either side of the aperture 176, thereby covering the aperture with the top layer and forming a channel. The base layer 172 and top layer 174 are then adhered by a ring of adhesive 182 to the flexible bag 100 so as to cover the hole 180 disposed through the first sidewall 102.

As will be appreciated by those of skill in the art, when the sidewalls 102, 104 of the bag 100 are forcibly compressed together, air from the internal volume 106 will pass through the hole 180 and the aperture 176 thereby partially displacing the top layer 174 from the base layer 172. The air can then pass along the channel formed between the adhesive strips 178 and escape to the environment. When the force on the sidewalls 102, 104 is released, the resilient top layer 174 will return to its prior configuration covering and sealing the aperture 176. The valve element 170 may also contain a viscous material such as an oil, grease, or lubricant between the two layers in order to prevent air from reentering the bag. In an embodiment, base layer 172 may also be a rigid sheet material.

Figure 6:
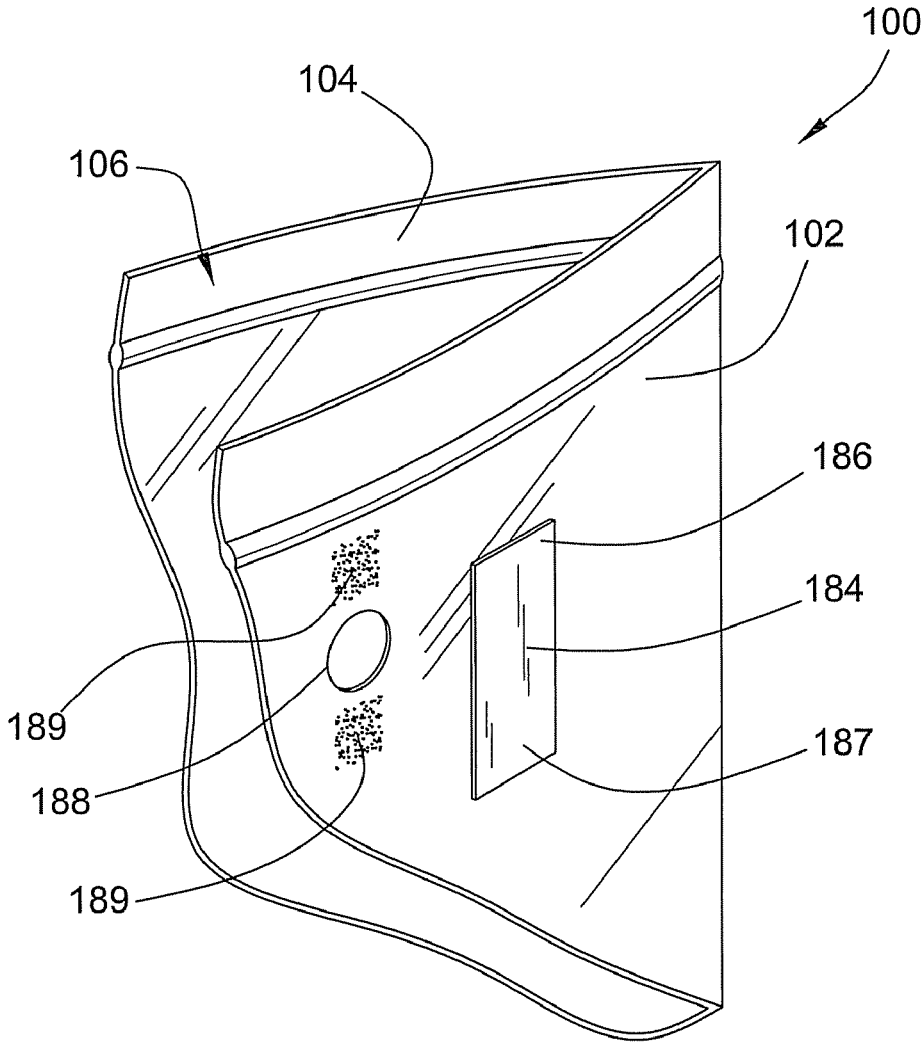
FIG. 6 is an exploded view of another embodiment of the one-way valve element for attachment to the flexible bag.

Illustrated in FIG. 6 is another embodiment of the valve element 184 that can be attached to the flexible plastic bag 100. The valve element 184 is a rectangular piece of flexible thermoplastic film that includes a first end 186 and a second end 187. The valve element 184 is attached to the first sidewall 102 so as to cover and seal a hole 188 disposed through the first sidewall 102. The valve element 184 can be attached to the sidewall 102 by patches of adhesive 189 placed on either side of the hole 188 so as to correspond to the first and second ends 186, 187. When the sidewalls 102, 104 of the flexible bag 100 are collapsed together, air from the internal volume 106 displaces the flexible valve element 184 so as to unseal the hole 188. After evacuation of air from the internal volume 106, the valve element 184 will again cover and seal the hole 188. As will be appreciated by those of skill in the art, other embodiments of one-way valve elements can be used with the flexible plastic bag such as, for example, an elastomer slit valve, duckbill valve or check valve.

Referring to FIG. 1 and from the foregoing description, it will be appreciated that if the inner surface 109 of the flexible second sidewall 104 is allowed to collapse adjacent to the first sidewall 102 proximate to the location of the one-way valve element 130, the valve element may become clogged preventing further evacuation of the bag 100. Furthermore if the first flexible sidewall 102 collapses adjacent the second flexible sidewall 104 or adjacent to the contents of the bag 100, the air may remain trapped in other regions of the bag. To prevent or reduce these problems, in accordance with the teachings of the invention, the bag 100 is provided with a textured portion 190 formed along an inner surface of one of the sidewalls. The textured portion maintains at least a partial clearance between the first and second sidewalls 102, 104 proximate the location of the valve element 130 to allow air from the internal volume 106 to access the valve element for exhausting.

Figure 7:
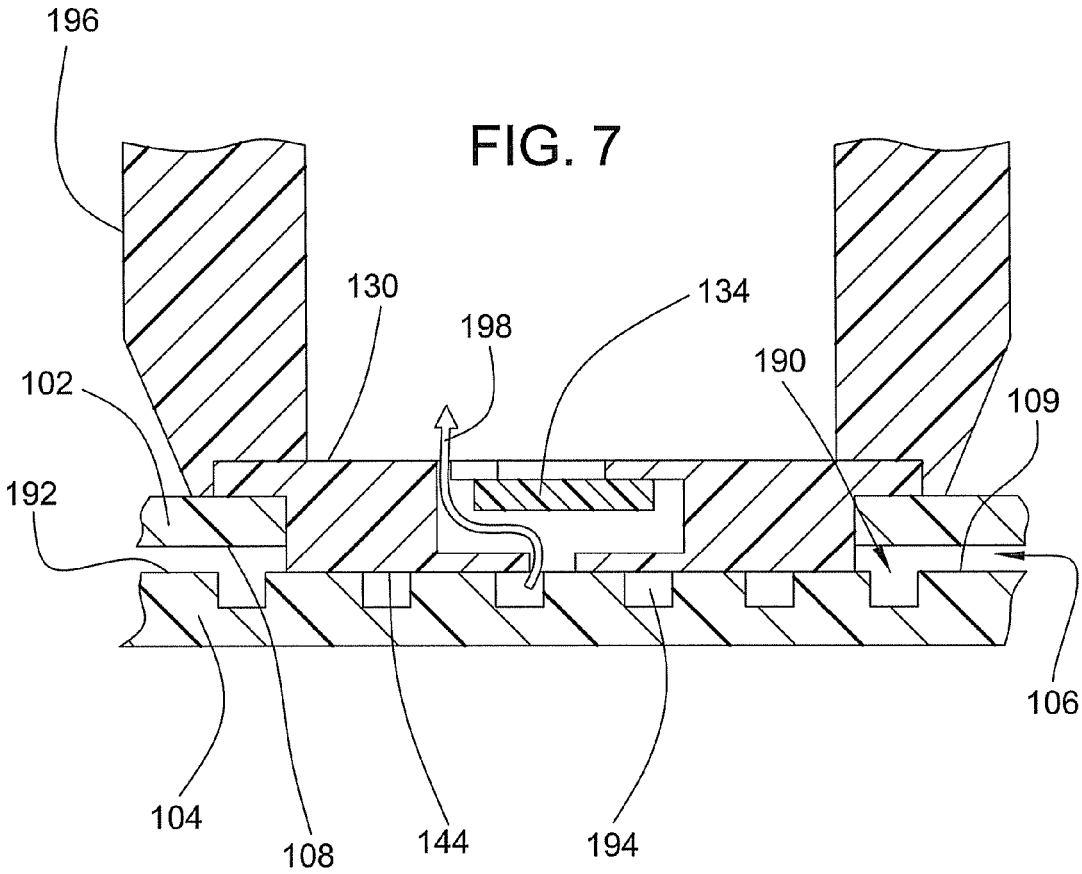
FIG. 7 is a cross-sectional view through the flexible bag and an embodiment of the one-way valve element engaging a nozzle of a vacuum source with the sidewalls of the bag collapsed together and a path of flow through the valve element indicated, as taken along line 7-7 of FIG. 1.

Referring to FIGS. 1 and 7, the textured portion 190 can include a plurality of alternating raised peaks 192 and recesses 194 that are formed into the inner surface 109. As illustrated in FIG. 7, when the valve element 130 is engaged to the nozzle 196 of a vacuum source to evacuate the internal volume 106 such that the first and second sidewalls 102, 104 collapse adjacent to each other, the raised peaks 192 contact the boss face 144 of the valve element 130 thereby providing clearances that function as evacuation passages within the recesses 194. Accordingly, the recesses 194 functioning as passageways allow air, indicated by arrow 198, from within the internal volume 106 to continually access the valve element 130 and thus the textured portion 190 prevents clogging of the valve element. The textured portion may be included on both sidewalls.

The vacuum source connected to the nozzle 196 in FIG. 7 can be any suitable vacuum source including, for example, hand-operated pumps, mechanical pumps, water aspirators, oral suction, and the like. Alternatively, the flexible bag can be evacuated by collapsing the flexible sidewalls together.

Figure 8:
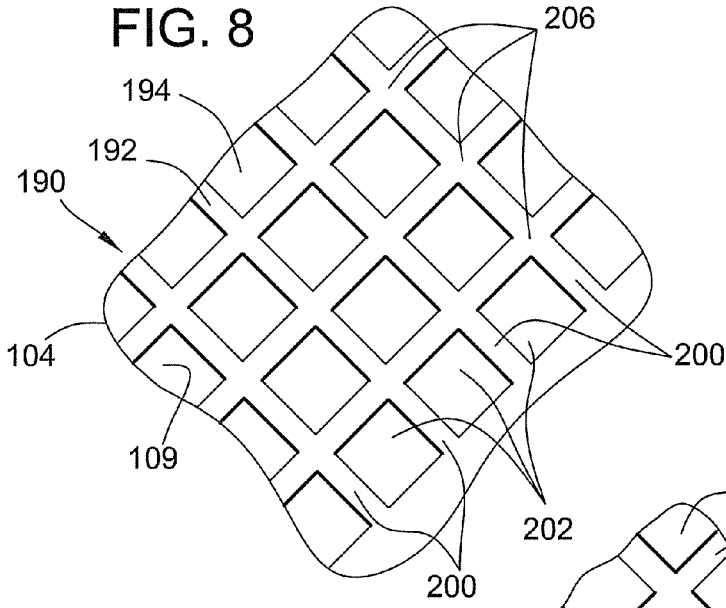
FIG. 8 is a detailed view of an embodiment of a textured portion on an inner surface of a sidewall of the flexible plastic bag, as taken about circle FIG. 8 of FIG. 1.
Figure 9:
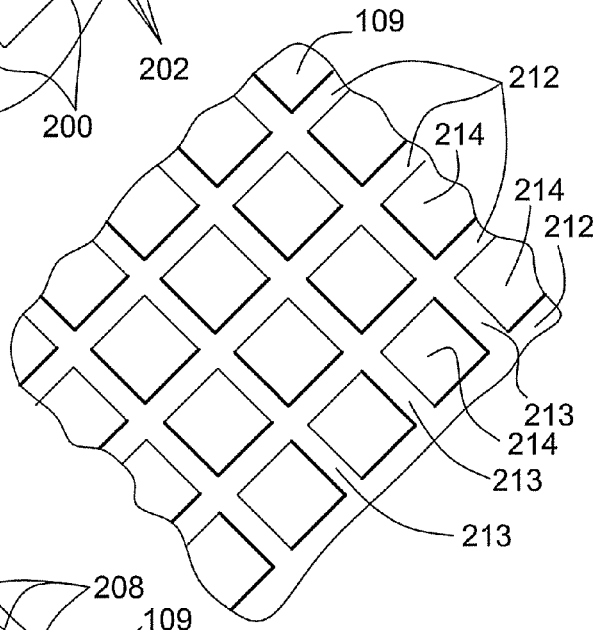
FIG. 9 is a detailed view of another embodiment of a textured portion formed as a plurality of groove disposed into an inner surface of the sidewall, taken about circle FIG. 9 of FIG. 1.
Figure 10:
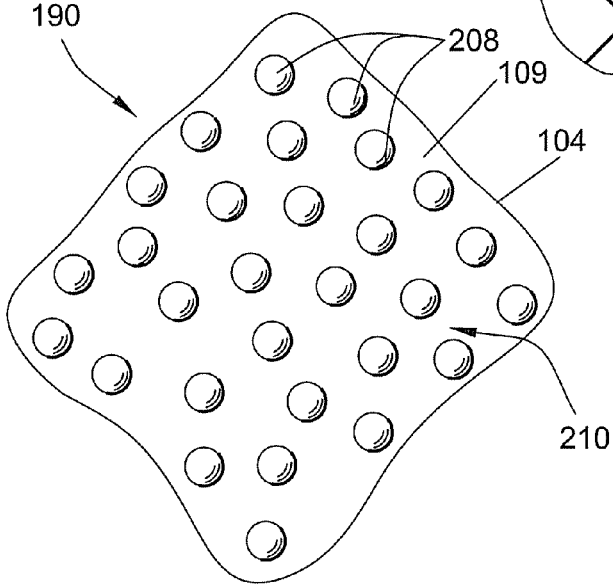
FIG. 10 is a detailed view of another embodiment of a textured portion on an inner surface of a sidewall of the flexible plastic bag, as taken about circle FIG. 10 of FIG. 1.

In the embodiment illustrated in FIG. 8, the peaks 192 can be formed along the crests of a first plurality of raised ridges 200 that extend along the inner surface. The first plurality of ridges 200 can be arranged parallel to and spaced-apart from each other. The recesses 202 that provide the passageways are therefore defined within the clearances between the ridges 192. In the illustrated embodiment, a second plurality of parallel ridges 206 extends along the inner surface normal to and intersecting the first plurality of ridges 200 to form a grid-like pattern. In another embodiment, the recesses providing the passageways can be formed within a grid-like pattern of grooves disposed into the inner surface, thus forming the raised peaks as a series of protuberances separated by the grooves. For example, in the embodiment illustrated in FIG. 9, a first and a second plurality of grooves 212, 213 are disposed into the textured portion 109 and are arranged orthogonally to each other. The grooves 212, 213 define a plurality of raised portion 214 that are square in shape. It will be appreciated that air can communicate along the grooves 212, 213 between the raised portions 214 even after the sidewalls have been collapsed together. In another embodiment illustrated in FIG. 10, the textured portion 190 can include protuberances 208 having smaller, circular shapes that are randomly dispersed along the inner surface 109 that are segregated from each other by arbitrarily-shaped recessed spaces 210 therebetween. Of course, the textured portion can have any other suitable shape, such as diamond-shaped ridges or grooves, horizontally arranged ridges or grooves, vertically arranged ridges or grooves, patterned or random curved-shaped ridges or grooves, etc. The textured portion may be included on both sidewalls.

The textured portion can be formed by any suitable method. For example, the textured portion can be formed by embossing or stamping the sidewall during manufacture of the bag. Additionally, the textured portion can be formed as a separate web and later adhered to the inner surface of the bag.

In accordance with another aspect of the invention, the textured portion can be arranged to facilitate the removal of fluids and juices from evacuating air. To accomplish this, for example, referring to FIG. 1, the inner surface 109 of the second sidewall 104 includes a first textured portion 190 along the top half of the bag 100 proximate the valve element 130 and a second textured portion 191 along the bottom half. (The top and bottom halves being indicated by the dashed line in FIG. 1.) The total volumetric capacity of the evacuating air that can be accommodated by the passageways per unit area of the first textured portion 190 is less than the total volumetric capacity per of the passageways per unit area of the second textured portion 191. Because of the reduction in volumetric capacity, and since pressure and volume are related, air being directed from the second textured portion to the first textured portion will experience a corresponding increase in pressure. The increased pressure will cause fluids and juices entrained in the evacuating air to condense prior to reaching the valve element and thereby prevents contamination of the valve element.

Decreasing volumetric capacity of passageways per unit area between the first textured portion and the second textured portion does not require that the total volumetric capacity of the passageways in the first textured portion be less than that total volumetric capacity of passageways in the second textured portion. Instead, its means that for any given unit area of the first and second textured portions, the passageways in that area of the first portion can accommodate less than the passageways in the equivalent area of the second portion. However, the total volumetric capacity of the passageways of the first textured portion may exceed that of the second textured portion. Moreover, the textured portion might not be provided as distinct first and second textured portion, but as a continuous textured portion in which volumetric capacity of passageways per unit area decreases with proximity to the valve.

The volumetric capacity of the textured portion can be changed in any suitable way. For example, referring to FIG. 11, there is illustrated an embodiment of a flexible storage bag 300 that provides an internal volume for receiving contents. The flexible storage bag 300 can further have a first side edge 310, a parallel second side edge 312 and a closed bottom edge 314. To access the internal volume of the bag 300, the top edge 316, which extends parallel to the bottom edge 314, can be selectively opened and closed by first and second fastening strips 320, 322. To evacuate the internal volume, the bag 300 can also have a valve element 330 attached to the first sidewall 302 proximate the upper corner delineated by the first side edge 310 and the top edge 316.

To provide a textured portion that reduces the amount of fluids and juices entrained in evacuating air, the textured portion 380 is provided as a pattern of interconnected grooves formed into the inner surface of the first sidewall 302. The groove pattern 380 includes a plurality of straight grooves 382 extending radially from a center point 384 along the bottom edge 314 of the bag. The groove pattern 380 can also include a plurality of curvilinear grooves 386 extending concentrically outward from the same center point 384 and that intersect the radial grooves 382. Because of the radial and concentric patterns of the grooves, it can be seen that fewer grooves are present proximate the top edge 316 of the bag and accordingly proximate the valve element 330 than are present proximate the bottom edge 314. The reduced number of grooves proximate the valve element 330 corresponds to a reduced passageway volume for the evacuating air per unit area of the textured portion such that entrained fluids can be condensed in the above manner. The textured portion may be included on both sidewalls.

Figure 11:
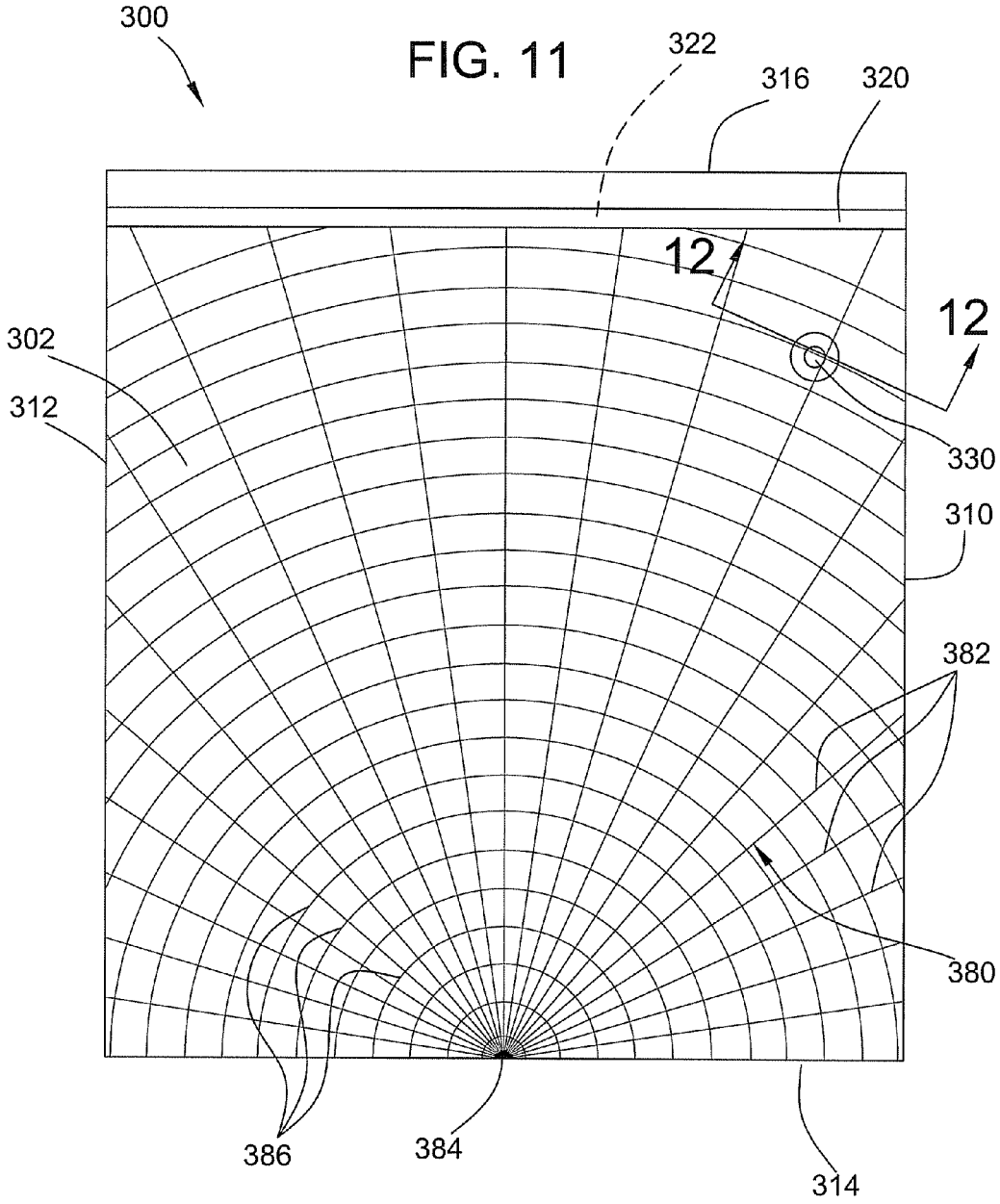
FIG. 11 is a front elevational view of a storage bag having a valve element and a textured pattern provided as a pattern of radially and concentrically arranged grooves.
Figure 12:
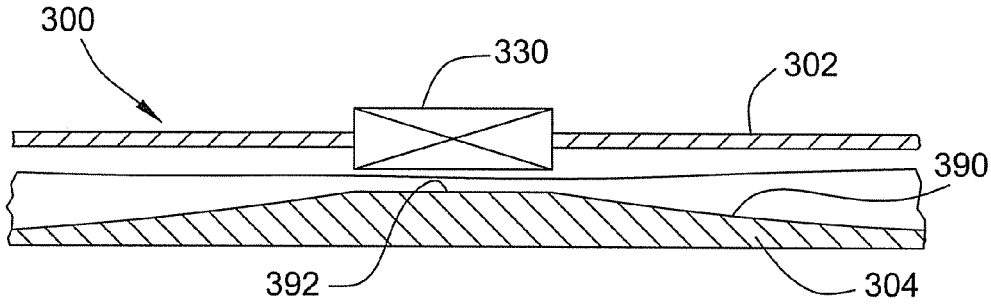
FIG. 12 is a cross-sectional view taken along line 12-12 of FIG. 11 illustrating changing groove depth.

Referring to FIG. 12, there is illustrated another manner of reducing the passageway volume of the textured portion proximate a valve element which can be employed separately or with a groove pattern such as that illustrated in FIG. 11. The valve element 330 is shown in cross-section attached to the first sidewall 302 of the bag 300 opposite the second sidewall 304. The textured portion 380 is provided as one or more grooves 390 disposed into the second sidewall 304 that extend proximate the valve element 330. The depth of the grooves 390 disposed into the second sidewall 304 can vary with respect to their proximity to the valve element 330. For example, the depth of the groove 390 proximate the valve element can have a depth of about 0.003 inches while the depth of the groove 390 located away from the valve element 330 can be about 0.010 inches. Preferably, the depth of the groove or grooves 390 disposed into the second sidewall 304 minimizes at a peak 392 opposite the valve element 330. The reduction of groove depth can result in the reduced passageway volume per unit area of textured portion for the evacuating air that in turn can result in entrained fluids being condensed. The textured portion may be included on both sidewalls.

Figure 13:
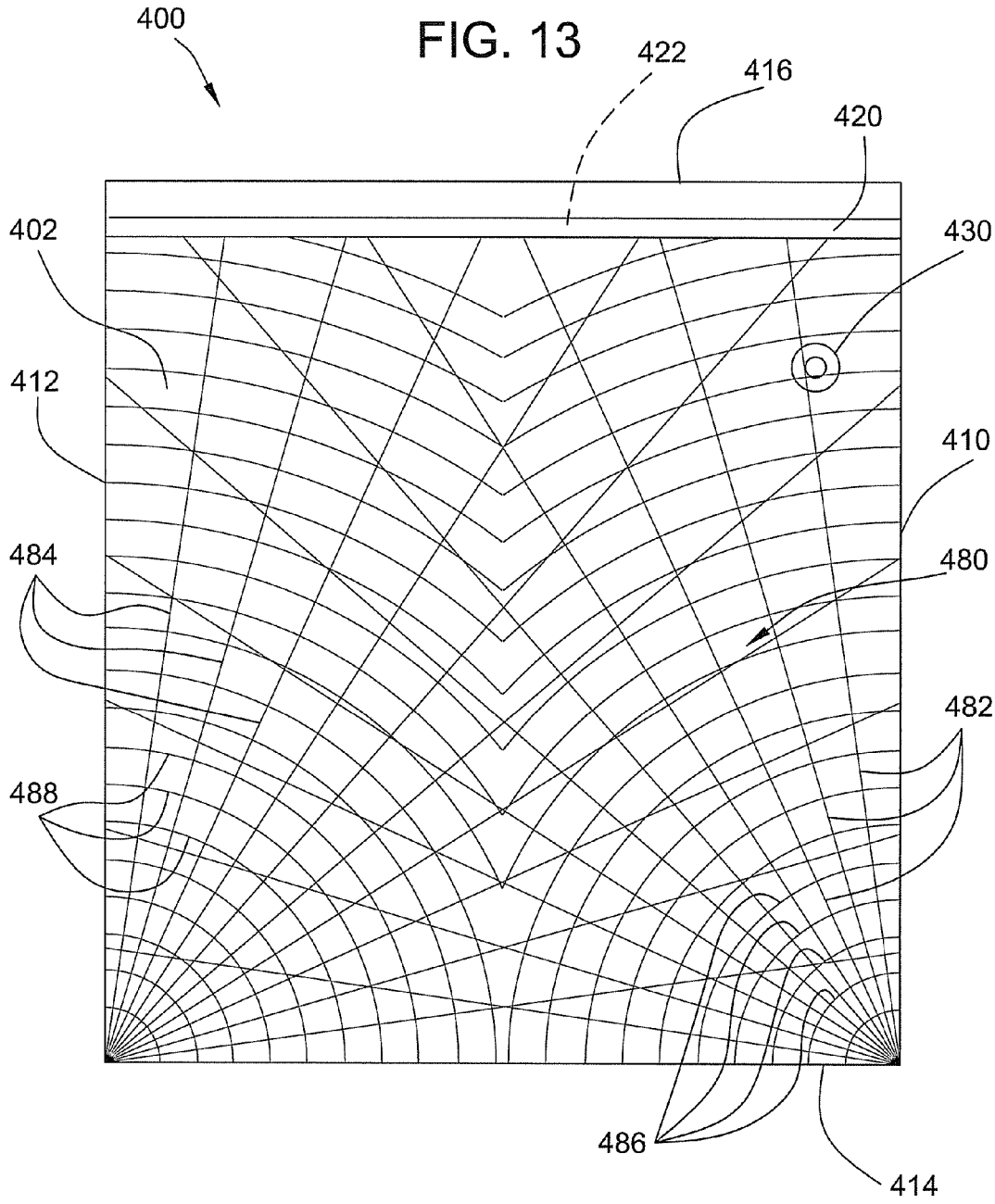
FIG. 13 is a front elevational view of a storage bag having a valve element and a textured portion provided as first and second patterns of radially and concentrically arranged grooves.

Referring to FIG. 13, there is illustrated another embodiment of a flexible storage bag 400 that provides an internal volume for receiving contents. The flexible storage bag 400 can have a first side edge 410, a parallel second side edge 412 and a closed bottom edge 414. To access the internal volume of the bag 400, the top edge 416, which extends parallel to the bottom edge 414, can be selectively opened and closed by first and second fastening strips 420, 422. To evacuate the internal volume, the bag 400 can also have a valve element 430 attached to the first sidewall 402 proximate the upper corner delineated by the first side edge 410 and the top edge 416.

To provide a textured portion that reduces the amount of fluids and juices entrained in evacuating air, the textured portion 480 is provided as a pattern of interconnected grooves formed into the inner surface of the first sidewall 402. The groove pattern 480 may include a first plurality of straight grooves 482 extending radially from a corner provided by the first side edge 410 and the closed bottom edge 414. A second plurality of straight grooves 484 extends radially from a corner provided by the second side edge 412 and the closed bottom edge 414. In addition to the first and second pluralities of straight grooves 482, 484, the textured portion may also include first and second pluralities of curvilinear grooves 486, 488 extending concentrically from each of the lower corners of the bag. The grooves disposed into the sidewall can interconnect to provide passageways for evacuating air. As can be seen, the number of grooves present near the top edge 416 of the bag, and hence the valve element 430, is less than the number of grooves present near the bottom edge 414 of the bag. The textured portion may be included on both sidewalls.

Figure 14:
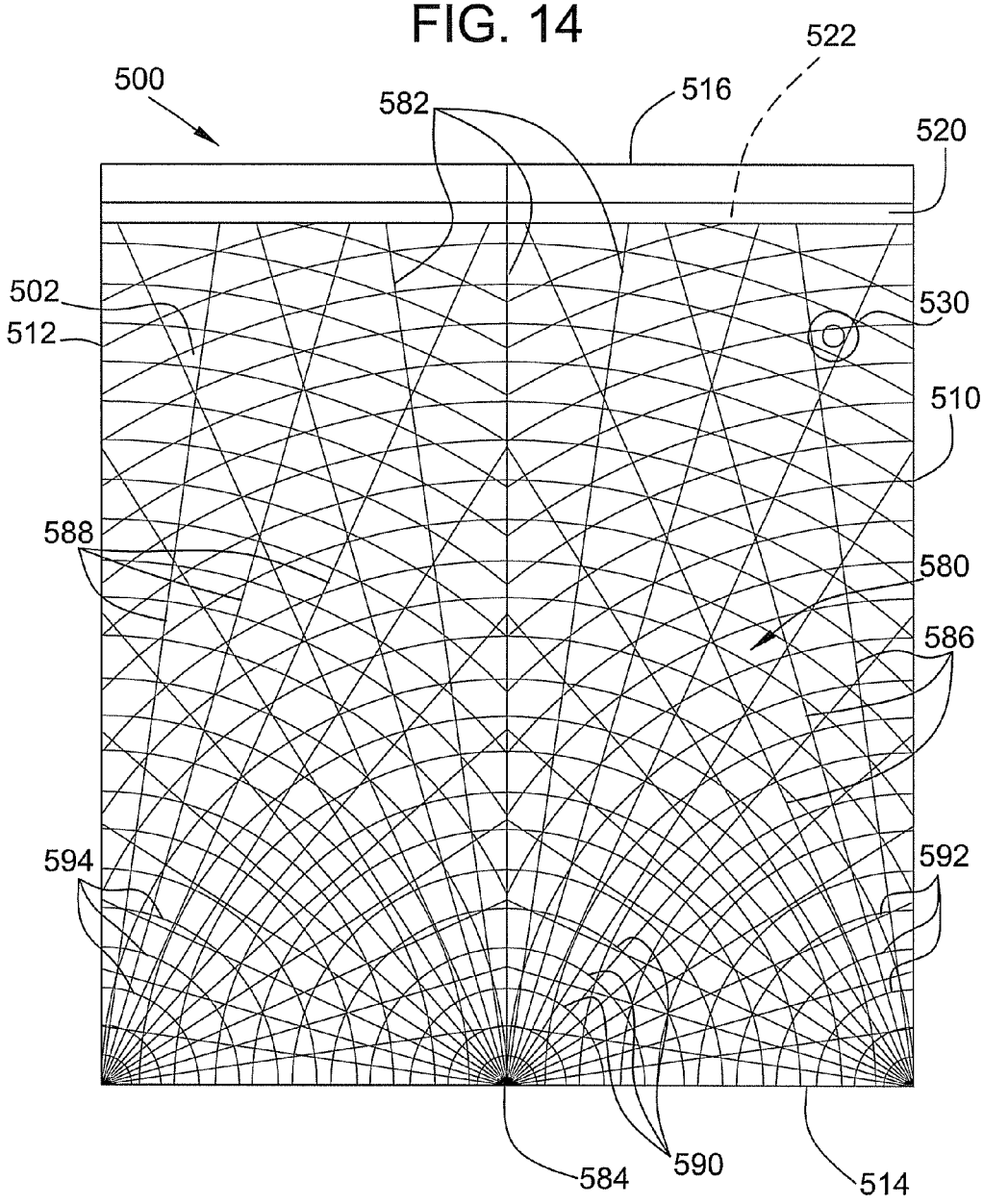
FIG. 14 is a front elevational view of another storage bag having a valve element and a textured portion provided as another pattern of radially and concentrically arranged grooves.

Referring to FIG. 14, there is illustrated another embodiment of a flexible storage bag 500 that provides an internal volume for receiving contents. FIG. 14 is a combination of FIG. 11 and FIG. 13. The flexible storage bag 500 can have a first side edge 510, a parallel second side edge 512 and a closed bottom edge 514. To access the internal volume of the bag 500, the top edge 516, which extends parallel to the bottom edge 514, can be selectively opened and closed by first and second fastening strips 520, 522. To evacuate the internal volume, the bag 500 can also have a valve element 530 attached to the first sidewall 502 proximate the upper corner delineated by the first side edge 510 and the top edge 516.

Again, the textured portion is provided as a pattern of grooves 580 disposed into the inner surface of the first sidewall 502. The groove pattern 580 may include a first plurality of straight grooves 582 extending radially from a center point 584 located midway along the closed bottom edge 514. The groove pattern 580 may also include a second plurality of straight grooves 586 extending from the corner delineated by the first side edge 510 and the closed bottom edge 514. The groove pattern 580 may also include a third plurality of straight grooves 588 extending radially from a corner provided by the second side edge 512 and the closed bottom edge 514. Extending concentrically outward from the center of each plurality of straight grooves are a respective plurality of concentric curvilinear grooves 590, 592, 594. Again, the grooves are more numerous near the top edge 516 than near the bottom edge 514 of the bag. The textured portion may be included on both sidewalls.

Figure 15:
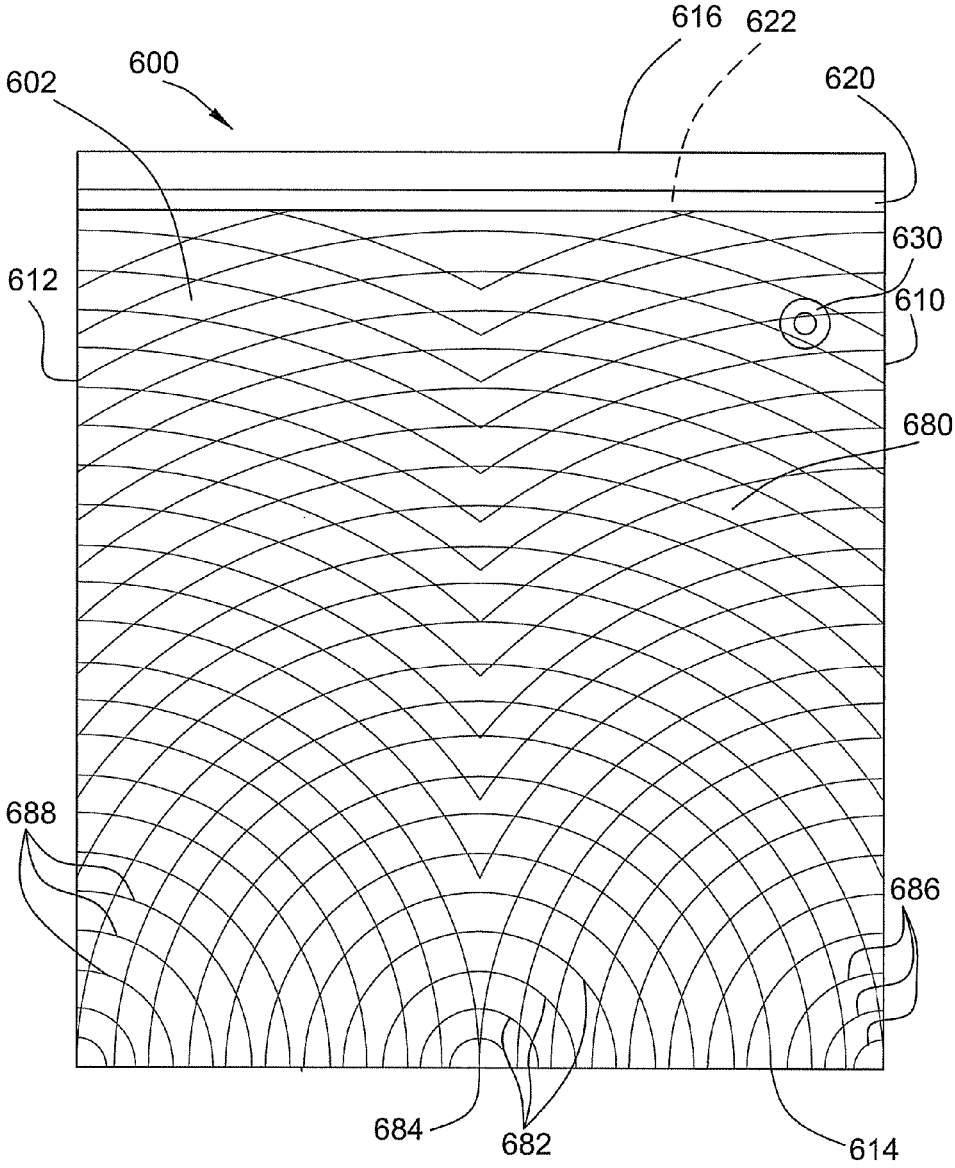
FIG. 15 is a front elevational view of another storage bag having a valve element and a textured portion provided as a pattern of concentrically arranged grooves.

Referring to FIG. 15, there is illustrated another embodiment of a flexible storage bag 600 having a textured portion 680 for conveying air to a valve element 630 attached to the first sidewall 602. FIG. 15 is similar to FIG. 14 but FIG. 15 does not include the straight grooves extending radially from the corners and the center point. The storage bag 630 includes a first side edge 610, a parallel second side edge 612, and a closed bottom edge 614 extending therebetween. To access the bag 600, the top edge 616 can be selectively opened and closed by fastening strips 620, 622. The textured portion can be provided as a plurality of curvilinear grooves 682 extending concentrically from a center point 684 located midway along the bottom edge 614. Additionally, the textured portion 680 can also include second and third pluralities of curvilinear grooves 686, 688 extending concentrically from the respective corners formed by the intersection of the first side edge 610 and the closed bottom edge 614 and the second side edge 612 and the closed bottom edge 614. The grooves can intersect to channel the evacuating air to the valve element 630. The textured portion may be included on both sidewalls.

Figure 16:
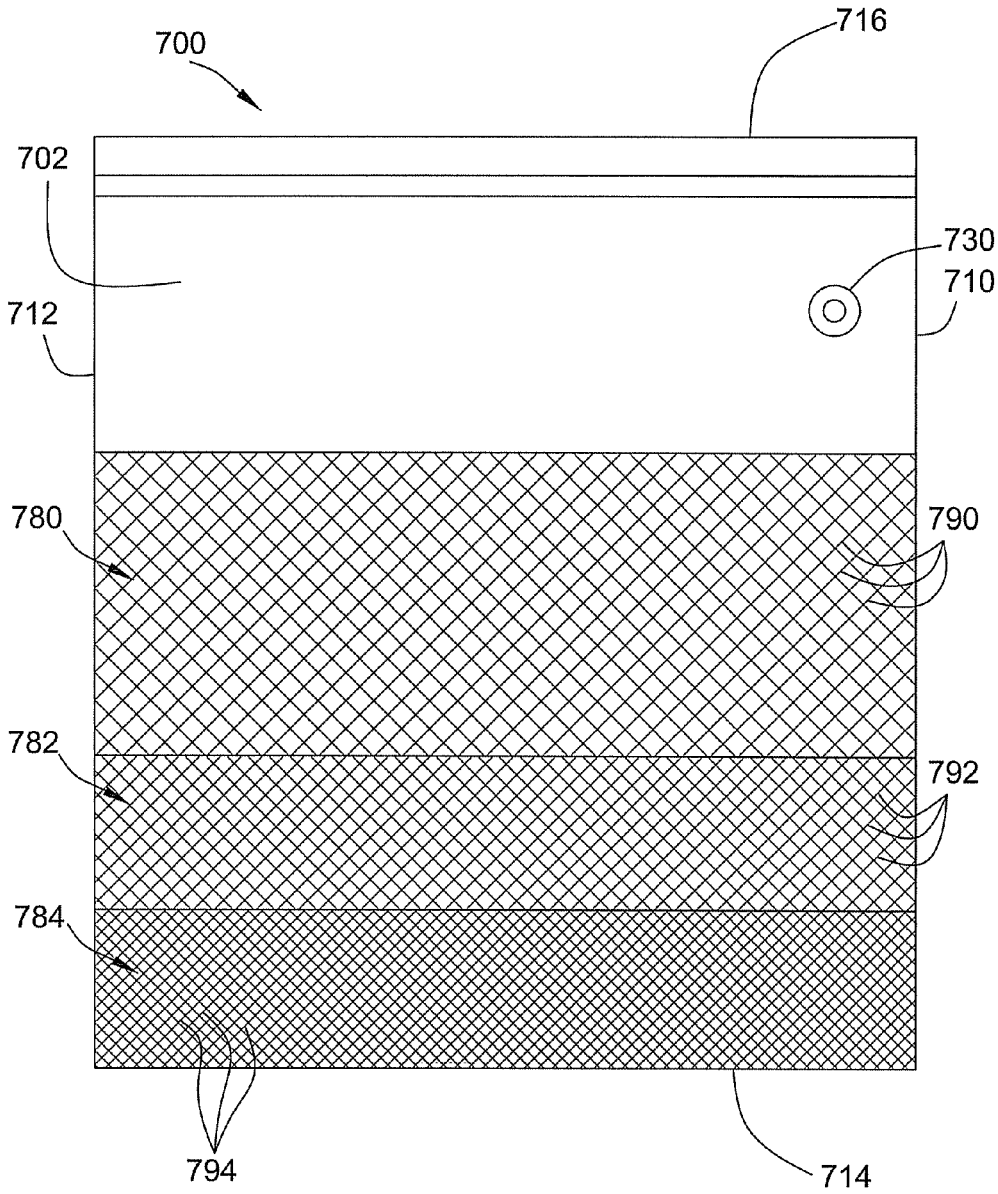
FIG. 16 is a front elevational view of another storage bag having a valve element and a first, a second and a third textured portions.

Referring to FIG. 16, there is illustrated another embodiment of a flexible storage bag 700 having first, second and third textured portions 780, 782, 784 for conveying air to a valve element 730 attached to the first sidewall 702. The third textured portion 784 may extend between the first and second side edges 710, 712 adjacently along the closed bottom edge 714 and may be comprised of a third plurality of interconnecting grooves 794 disposed into the first sidewall 702 and arranged in diamond pattern. The second textured portion may also extend between the first and second side edges 710, 712 but is offset from the closed bottom edge 714 by the third textured portion 784. The second textured portion 782 may also be comprised of a second plurality of interconnected grooves 792 arranged in diamond pattern. The number of grooves 792 making up the second plurality is fewer than the number of grooves 794 making up the first plurality, hence, the second textured portion 792 has less volumetric capacity for evacuating air per equivalent unit area than the third textured portion 794. The first textured portion 780 may likewise extend between the first and second side edges 710, 712 above the third and second textured portions 784, 782. Additionally, the first textured portion 780 may also be made of a first plurality of grooves 790 arranged in a diamond pattern. The first plurality 790 includes less grooves than the third and second pluralities of grooves 794, 792 and accordingly the first textured portion 780 has less volumetric capacity than the second and third textured portions 782, 784. In another embodiment, rather than changing the number of grooves provided in each textured portion, the same result can be achieved by changing the depth of the grooves in each textured portion. The textured portion may be included on both sidewalls.

In the storage bag 700 illustrated in FIG. 16, no additional texturing is included between the third textured portion 784 and the top edge 716, hence, air evacuating from the bag can move to the valve element 730 unimpeded. Accordingly, in this particular embodiment, all condensation of fluids from evacuating air occurs due to air flowing through the groove pluralities of varying capacities. In other embodiments, the texturing may extend to the valve element as noted herein.

Figure 17:
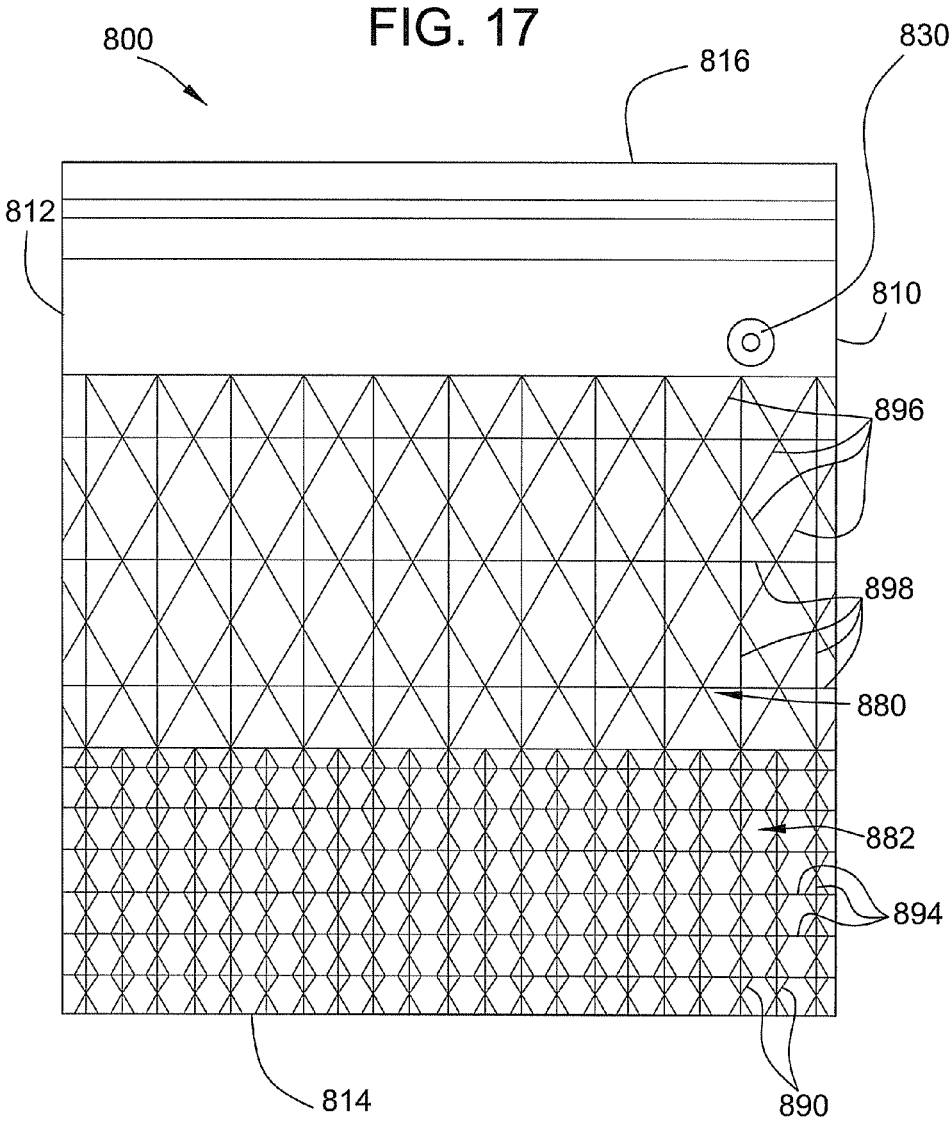
FIG. 17 is a front elevational view of another storage bag having a valve element and first and second textured portions provided as a plurality of grooves arranged in a diamond pattern.

Referring to FIG. 17, there is illustrated another embodiment of a flexible storage bag 800 having a first textured portion 880 and a second textured portion 882. The first and second textured portions 880, 882 are positioned below the open top end 816 and the one-way valve element 830. The second textured portion 882 may include a plurality of interconnected grooves 890 arranged in a diamond pattern that extends between the first side edge 810 and the second side edge 812 along the bottom edge 814. In addition to the diamond pattern grooves 890, the second textured portion 882 can have a second plurality of grooves 894 arranged orthogonally and intersecting with the diamond pattern grooves. The first textured portion 880 may extend adjacently above the second textured portion 882 between the first and second side edges 810, 812. The first textured portion 880 can also have a second diamond patterned plurality of grooves 896 and a second orthogonal patterned plurality of grooves 898. The number of grooves in the first textured portion 880 is less than the number of grooves in the second textured portion 882, and thus the volumetric capacity of the first textured portion is less than the volumetric capacity of the second textured portion. In other embodiments, the texturing may extend to the valve element as noted herein. The textured portion may be included on both sidewalls.

Figure 18:
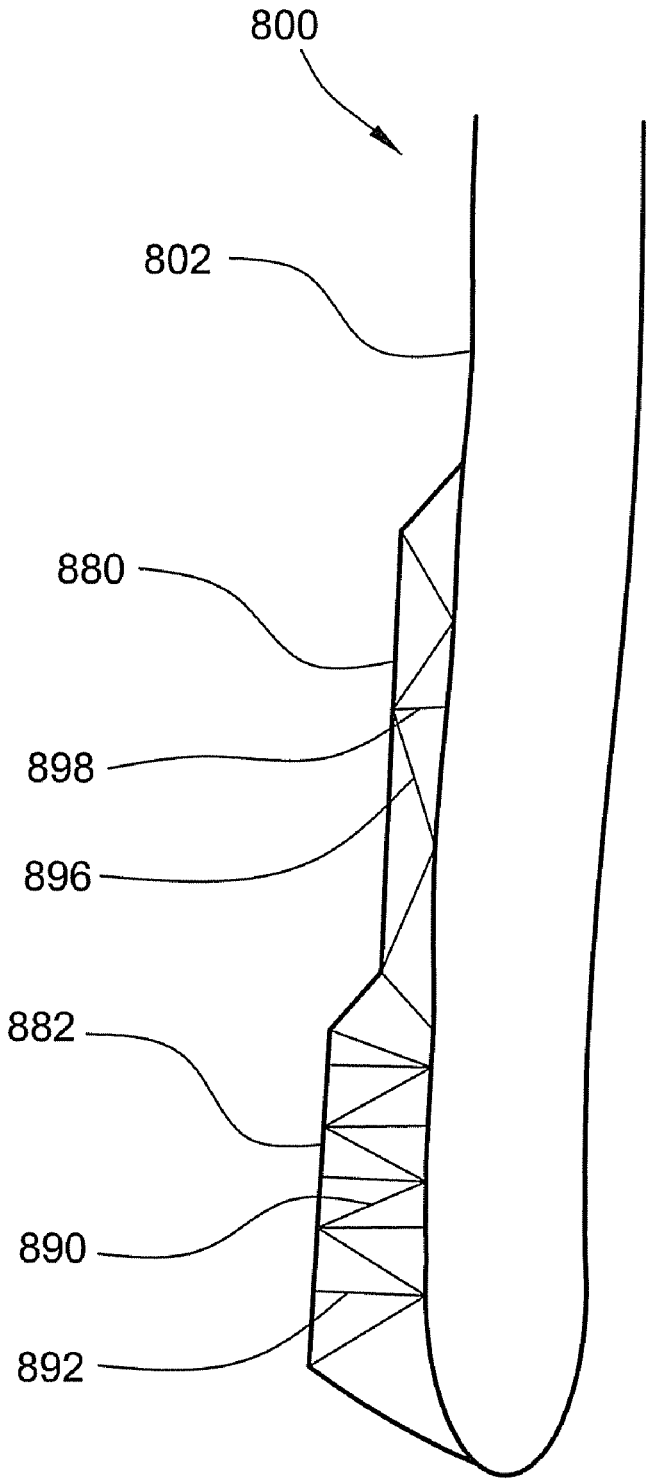
FIG. 18 is a cross-sectional view of the storage bag of FIG. 17 showing the first and second textured portions protruding from the first sidewall.

Referring to FIG. 18, the grooves disposed into the first sidewall 802 of the flexible storage bag can have varying depths. For example, the grooves 896, 898 of the first textured portion 880 may protrude from the surface of the first sidewall 802 a first given distance. The grooves 890, 892 of the second textured portion 882 likewise protrude a second given distance which is greater than the first given distance. Because of the varying depths of the grooves, the volumetric capacity of the second textured portion is greater than the volumetric capacity of the first textured portion. In other embodiments, the texturing may extend to the valve element as noted herein. The textured portion may be included on both sidewalls.

Figure 19:
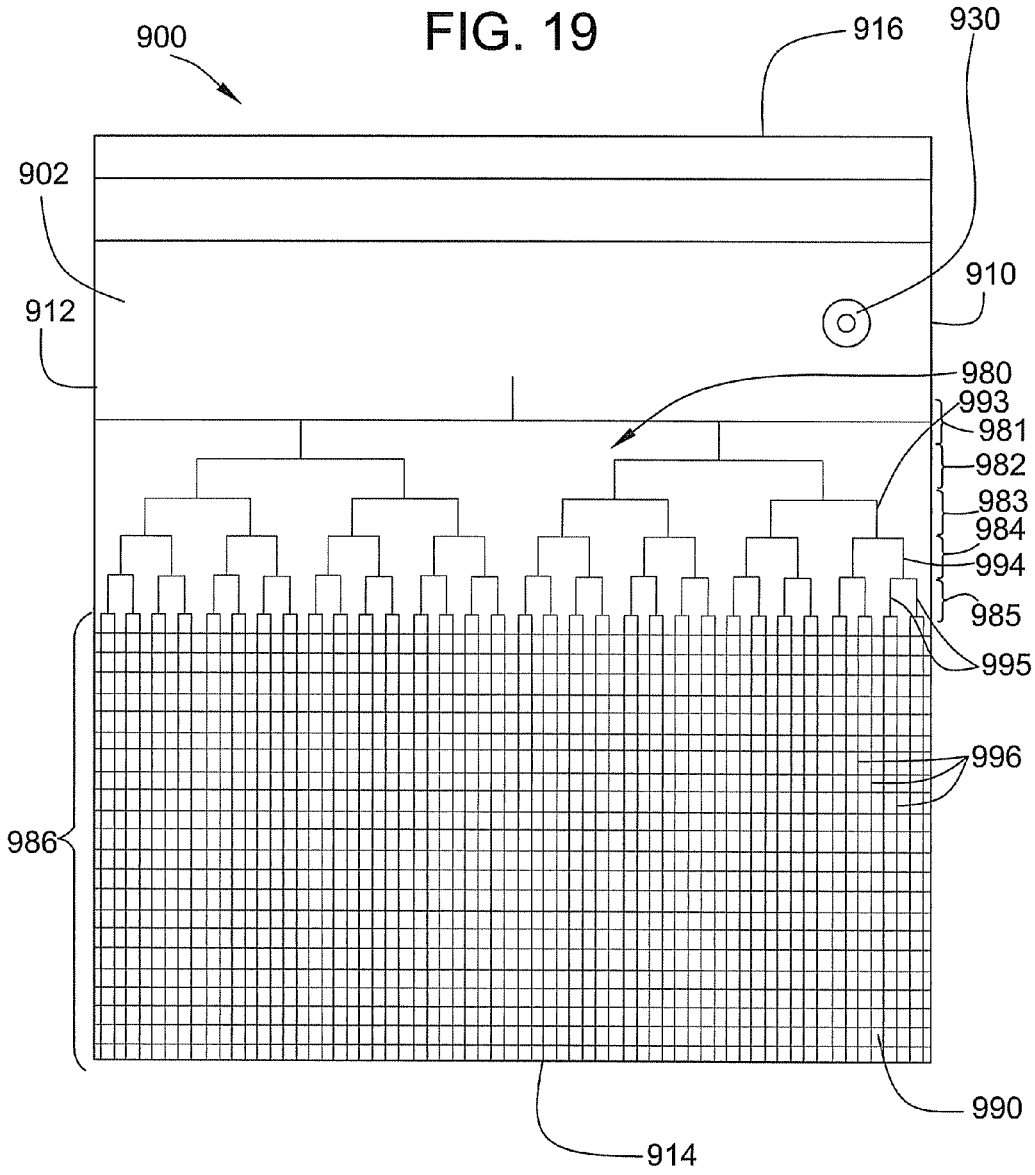
FIG. 19 is a side elevational view of another storage bag having a valve element and a textured portion provided as a plurality of grooves arranged in binary pattern.

Referring to FIG. 19, there is illustrated another embodiment of a flexible storage bag 900 having a textured portion 980 on the inner surface of a first sidewall 902. The textured portion 980 may extend between a first side edge 910 and a second side edge 912 and is generally located below the open top edge 916 and the valve element 930. The textured portion 980 can include a first textured portion 981, a second textured portion 982, a third textured portion 983, a fourth textured portion 984, a fifth textured portion 985 and a sixth textured portion 986. Each textured portion is formed of a plurality of generally upward extending grooves 990 disposed into the first sidewall 902 that are arranged in a binary pattern. Specifically, each pair of grooves within each textured portion merge together to form a single groove of the next textured portion. For example, the grooves 996 of the sixth textured portion 986 merge together to form the grooves 995 of the fifth textured portion 985. Each pair of grooves 995 of the fifth textured portion 985 then merge to form a single groove 994 of the fourth textured portion 984. Again, each pair of grooves 994 of the fourth textured portion 984 merge to form a single groove 993 of a third textured portion 983 and so on such that the number of grooves of each successive textured portion is reduced by half. In other embodiments, the texturing may extend to the valve element as noted herein. The textured portion may be included on both sidewalls.

Figure 21:
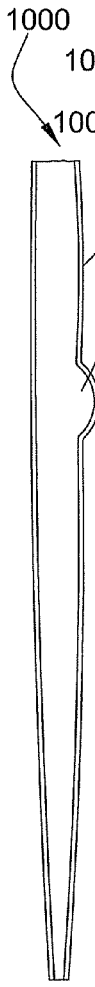
FIG. 21 is a side elevational view of the storage bag of FIG. 20 showing the drop out zones protruding from the first sidewall.
Figure 20:
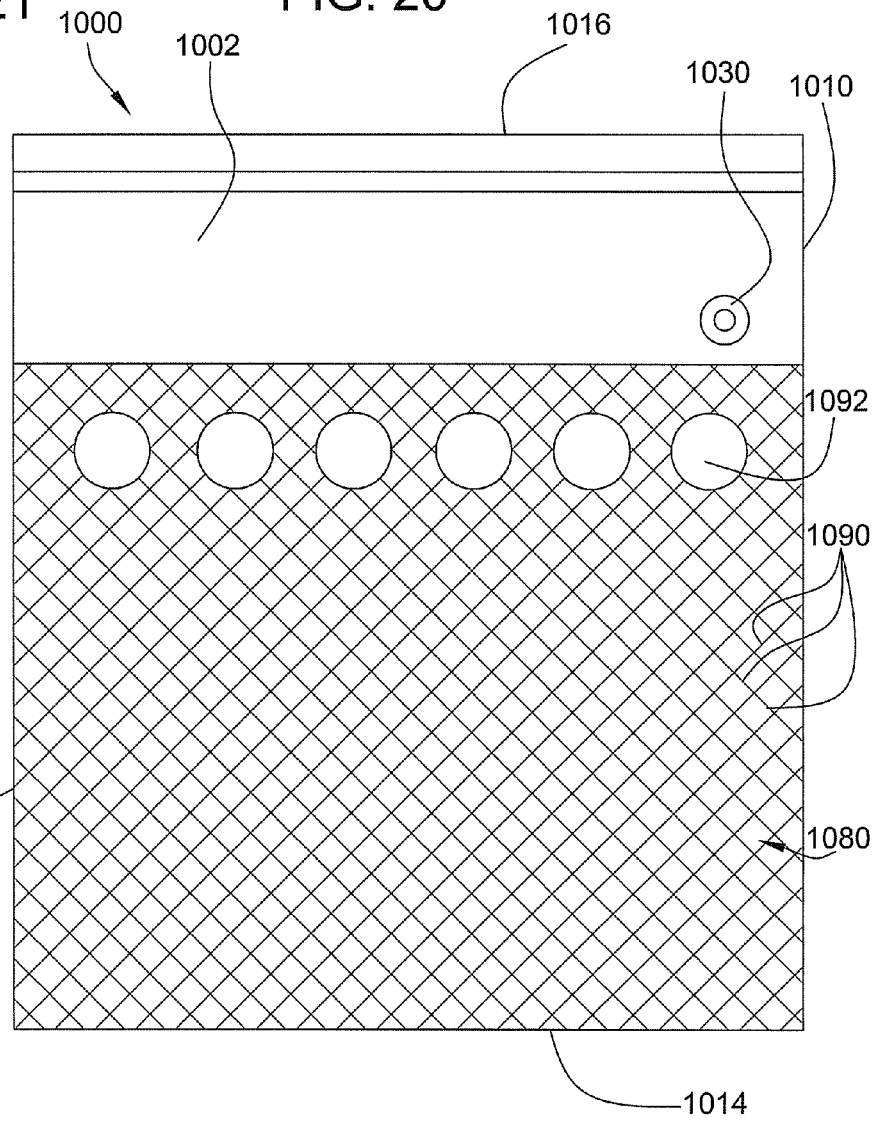
FIG. 20 is a front elevational view of another storage bag having a valve element and a textured portion provided as a plurality of grooves arranged in diamond pattern and further including drop out zones provided in the flexible sidewall.

Referring to FIGS. 20 and 21, there is illustrated another embodiment of a storage bag 1000 having a textured portion 1080. The textured portion 1080 may extend between the first and second side edges 1010, 1012 along the closed bottom edge 1014 and is positioned below the open top edge 1016 and the one-way valve element 1030. The textured portion 1080 may include a plurality of grooves 1090 disposed into the second sidewall 1002 and arranged in a diamond pattern. To assist in removing liquids otherwise entrained in the exhausting air, the bag 1000 can include a plurality of drop out zones 1092 formed proximate the textured portion 1080. The drop out zones 1092 can be bubbles 1094 disposed into the first sidewall 1002 which provides voids in which entrained liquids may be trapped. By positioning the drop out zones 1092 near the top of the textured portion 1080 proximate the valve element 1030, air from the interior volume will typically pass across the zone during exhaustion and can thus have the amount of entrained fluid reduced. In other embodiments, the texturing may extend to the valve element as noted herein. The textured portion may be included on both sidewalls.

Figure 22:
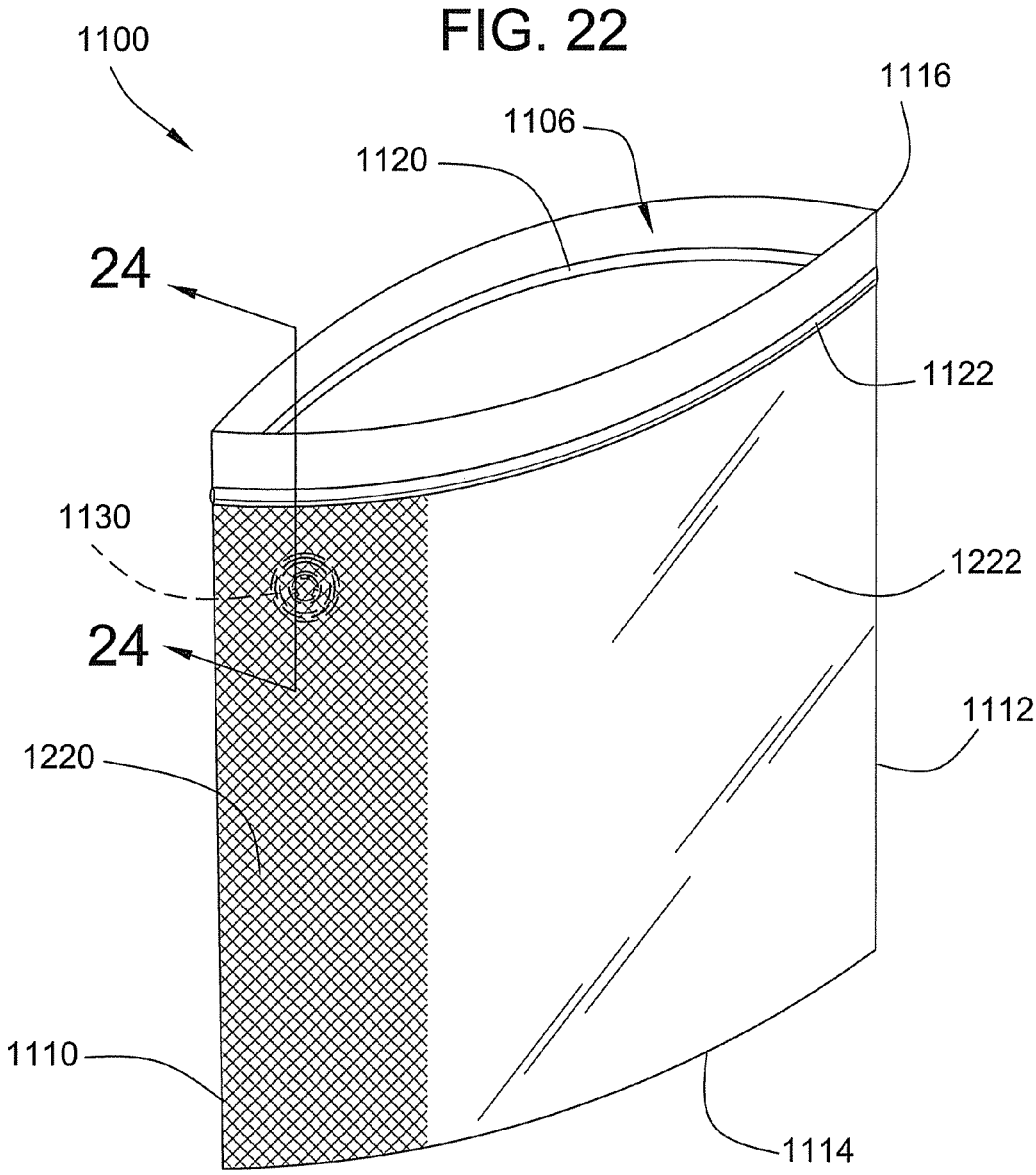
FIG. 22 is a perspective view of another embodiment of the flexible bag having an open top, a textured portion along a side edge, and a one-way valve element.
Figure 23:
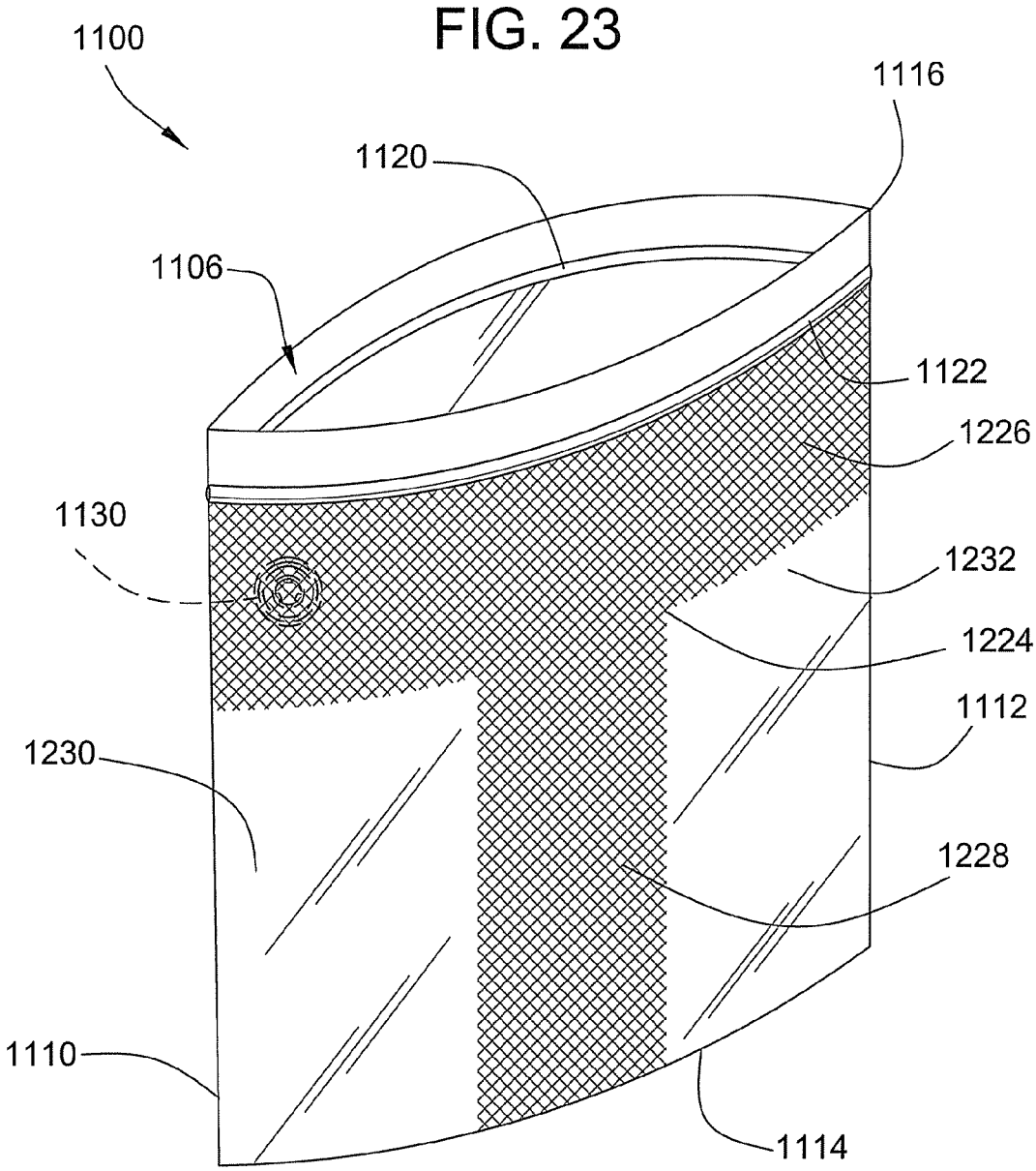
FIG. 23 is a perspective view of another embodiment of the flexible bag having an open top, a textured portion provided with a T-shape, and a one-way valve element.

Of course, in other embodiments, the textured portion need not be provided over substantially the entire inner surface. For example, in the embodiment illustrated in FIG. 22, the textured portion is provided as a relatively narrow, vertical strip 1220 along the first edge 1110 of the second sidewall 1104 arranged to correspond to the valve element 1130. The remainder of the second inner surface is formed as a substantially smooth portion 1222. An advantage of providing the textured portion as a narrow strip 1220 adjacent the smooth portion 1222 is that food items stored in the internal volume 1106 are less likely to contact the textured portion, and are therefore less likely to retain unsightly impressions upon removal from the bag 1100. In another embodiment illustrated in FIG. 23, the textured portion is provided as a T-shape 1224 having a horizontal strip 1226 and an intersecting vertical strip 1228. The horizontal strip 1226 extends between the first and second side edges 1110, 1112 while being spaced-apart from the bottom edge 1114. The vertical strip 1228 extends between the bottom edge 1114 and the horizontal strip 1226 while being spaced-apart from the first and second side edges 1110, 1112. Accordingly, the T-shape textured portion 1224 can extend substantially throughout the internal volume 1106 between the opposing side edges 1110, 1112 and the top and bottom edges 1114, 1116 while still providing substantially smooth portions 1230, 1232.

Figure 24:
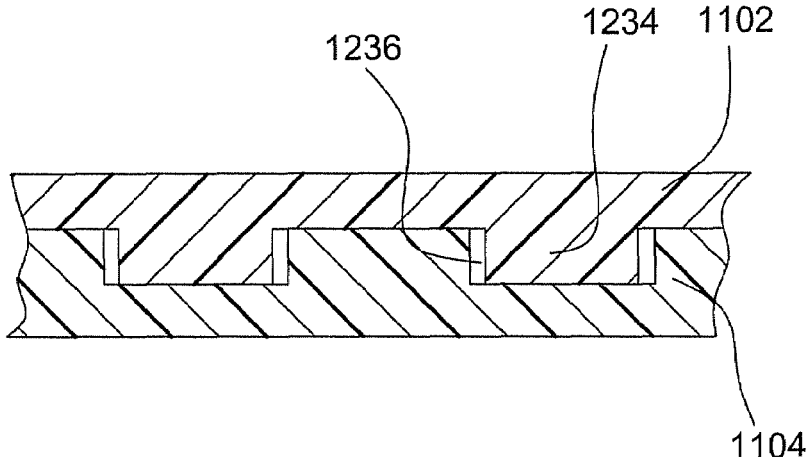
FIG. 24 is a partial cross-sectional view through an embodiment of the flexible bag with the sidewalls of the bag collapsed together, as taken along line 24-24 of FIG. 22.

In another embodiment illustrated in FIG. 24, to maximize exhaustion of the flexible bag wherein the textured portion is located on both the first and second sidewalls 1102, 1104, the peaks 1234 and recesses 1236 can be arranged and sized to cooperate so as to minimize the remaining internal volume as the sidewalls collapse together. For example, the peaks 1234 located on each sidewall are received in corresponding recesses 1236 formed on the opposing sidewall to interlock together.

Figure 25:
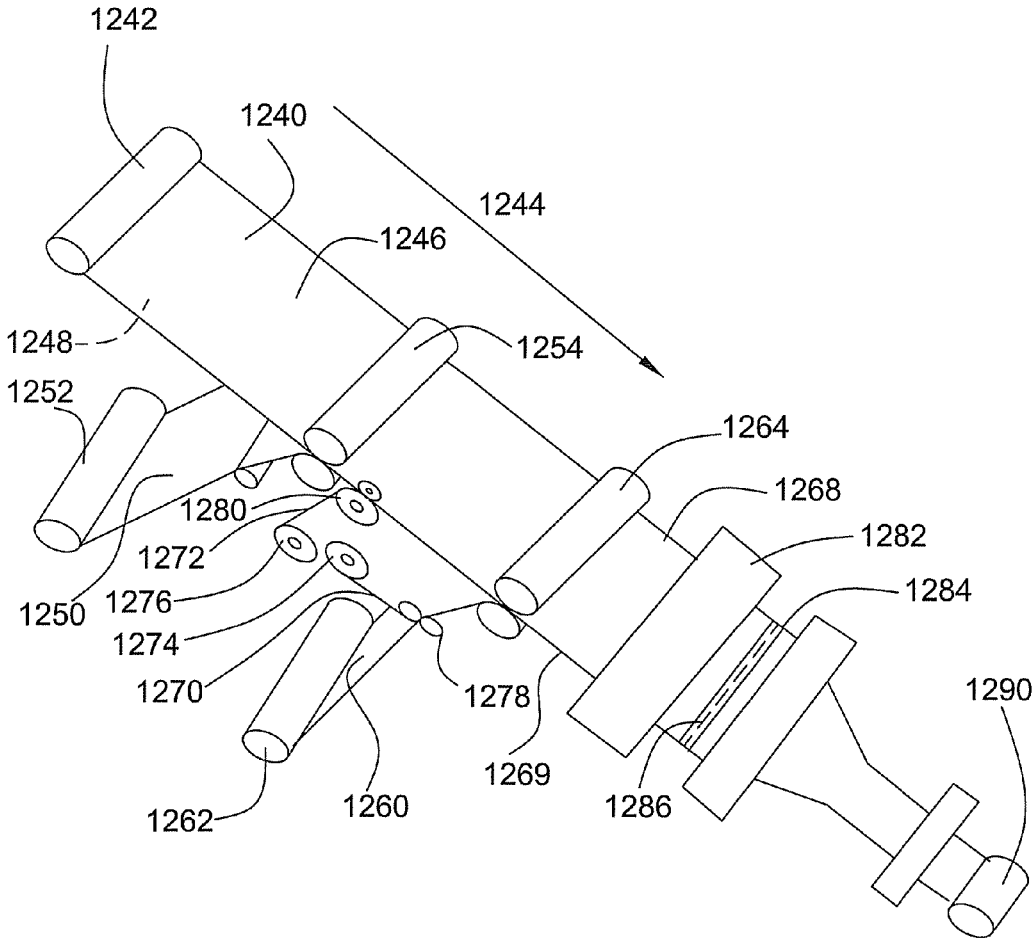
FIG. 25 is a general schematic view illustrating a method for producing a flexible bag having a textured portion using continuous webs of plastic.

To produce a flexible bag having a textured portion, webs of flexible thermoplastic material can be manipulated through a high speed manufacturing process such as that illustrated in FIG. 25. In the manufacturing process, a first web 1240 of thermoplastic material is continuously unwound from a roll 1242 and aligned in and advanced along a machine direction 1244 through the processing machines. The first web of material 1240 accordingly has a first surface 1246 and a second surface 1248.

A second web 1250 of thermoplastic material is provided wound onto a second roll 1252 located below the first roll. Embossed into the material of the second web 1250 are pluralities of peaks and recesses that form the textured portion of the finished flexible bag. The second web 1250 is continuously unwound from the second roll 1252 and aligned with the machine direction 1244 where it is attached to the second surface 1248 of the advancing first web 1240 by web attachment rollers 1254. As will be appreciated, the attached first and second webs 1240, 1250 will form the second sidewall of the finished flexible bag.

To provide the first sidewall, a third web 1260 of thermoplastic material is provided wound onto roll 1262. The third web 1260 is continuously unwound and aligned with the first and second webs 1240, 1250 in the machine direction 1244. After alignment, the third web 1260 is attached to the first and second webs 1240, 1250 at a second set of web attachment rollers 1264. In order to form the open top edge of the finished bag, the third web 1260 is only attached to the first and second webs 1240, 1250 along a first edge 1268 of the combined webs while the parallel second edge 1269 remains unattached.

To provide the fastening strips on the finished bag, the first and second fastening strips 1270, 1272 can be provided as elongated thermoplastic extrusions wound onto first and second strip rolls 1274, 1276. The first fastening strip 1270 is unwound and aligned with the third web 1260 to which the first fastening strip is attached by strip attachment rollers 1278. The second fastening strip 1272 is unwound and aligned in the machine direction 1244 with the first and second webs to which the second fastening strip is continuously attached by strip rollers 1280. As illustrated in FIG. 25, the first and second fastening strips 1270, 1272 are aligned with the unattached second edge 1269 of the combined webs. Preferably, attachment of the fastening strips to the continuously advancing webs of thermoplastic material occurs between the first and second web attachment rollers 1254, 1264.

As the attached webs and strips are advanced in the machine direction 1244, the side edges of the finished bag may be produced by an edging machine 1282. Specifically, the edging machine 1282 forms a seal 1284 across the width of the attached webs and then cuts perforations 1286 along the seal. The perforated webs can then be folded by a folding machine 1288 and wound into a roll 1290 for distribution. Later, individual bags can be unwound and detached from the roll 1290 along the perforated seals.

In another embodiment, instead of providing the textured portion in the form of a separate web of material, the textured portion can be formed directly onto the first web 1240 of advancing material. For example, the second roll 1252 and second web 1250 of material can be eliminated and the first web attachment rollers 1254 can be replaced with an embossing machine that forms the peaks and recesses directly onto the first web 1240.

Figure 26:
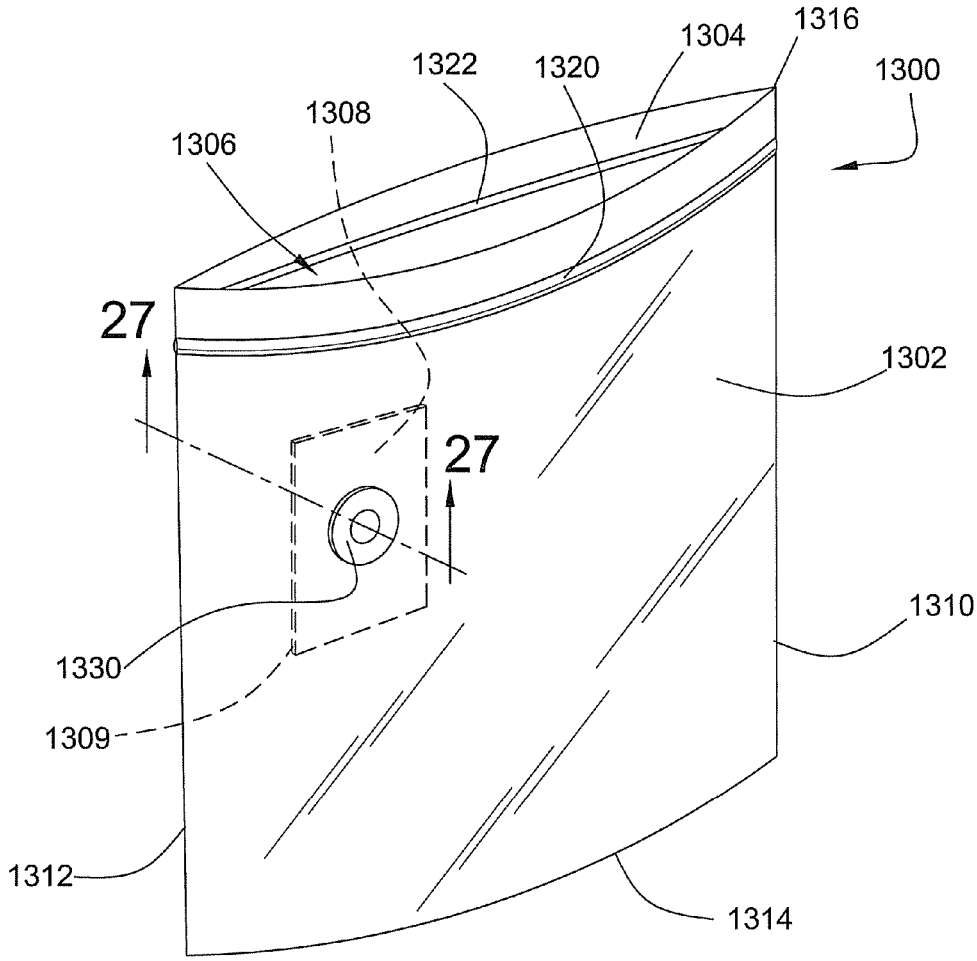
FIG. 26 is a perspective view of another embodiment of a flexible bag having an open top, a permeable element, and a one-way valve element.
Figure 27:
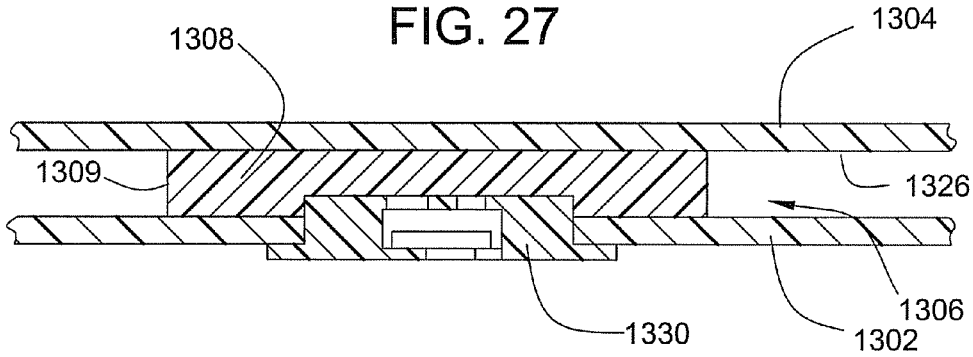
FIG. 27 is a cross-sectional view through the flexible bag, permeable element, and one-way valve element with the sidewalls of the bag collapsed together, as taken about line 27-27 of FIG. 26.

In another aspect of the invention, as illustrated in FIGS. 26 and 27, the clearance member can be provided as a permeable element 1308 located in the internal volume 1306 of the flexible bag 1300. In addition to the permeable element 1308, the flexible bag 1300 includes overlaying first and second sidewalls 1302 and 1304 that are sealed together along first and second side edges 1310, 1312 and a closed bottom edge 1314. To access the internal volume 1306, the edges of the first and second sidewalls 1302, 1304 that are parallel to the closed bottom edge 1314 remain unsealed to form an open top edge 1316. To releasably close the open top edge 1316 after insertion of an item, first and second fastening strips 1320, 1322 are provided. To evacuate air from the flexible bag after sealing the fastening strips, a one-way valve element 1330 is attached to the first sidewall 1302 and communicates with the internal volume 1306.

The permeable element 1308 can be provided as a thickened planar sheet outlined by a peripheral edge 1309 that defines the shape of the permeable element. The permeable element can be attached by, for example, adhesive to an inner surface 1324 of the first sidewall 1302 such that the permeable element overlays and covers the one-way valve element 1330. In another embodiment, the permeable element 1308 can be attached to the second sidewall 1304 opposite the valve element 1330. The permeable element 1308 is characterized in that it comprises a material that demonstrates a high degree of air permeability.

As illustrated in FIG. 27, during evacuation of the flexible bag 1300, as the second sidewall 1304 collapses toward the first sidewall 1302, an inner surface 1326 of the second sidewall 1304 contacts the permeable material 1308 and is therefore spaced-apart from the valve element 1330. Air from the internal volume 1306 of the bag 1300, however, can still access the exposed peripheral edge 1309 of the permeable element and permeate through to the valve element 1330.

Examples of various permeable materials suitable for the permeable element include any of various nonwoven materials such as, but not limited to, melt blown, spun bond, hydroentangled, needle punched, batting, dry-laid or wet-laid. Preferably, the selected nonwoven material demonstrates a hydrophobic property that permits air to permeate through but retains liquids. As will be appreciated, such a hydrophobic permeable material would prevent fluids from leaking through the one-way valve element or from drying out within the valve element. A preferred material is polypropylene but the nonwoven material could also be made from polyester, nylon, or polyethylene. Other examples of suitable permeable materials include porous materials such as open celled foams such as sponges, porous substrates, and sintered materials.

In another aspect of the invention, the clearance member can be provided as a rigid structure that functions to space the sidewalls apart from each other in the proximity of the valve element during evacuation. The rigid clearance member may include slots or notches disposed into it that permit air from the internal volume to access the valve element. Because of the combined effect of the rigid clearance member in spacing the sidewalls apart and providing access to the valve element, clogging of the valve element is prevented. Preferably, the rigid clearance member is engaged to the valve element itself but in some embodiments the rigid clearance member can be attached to the opposing sidewall.

Figure 28:
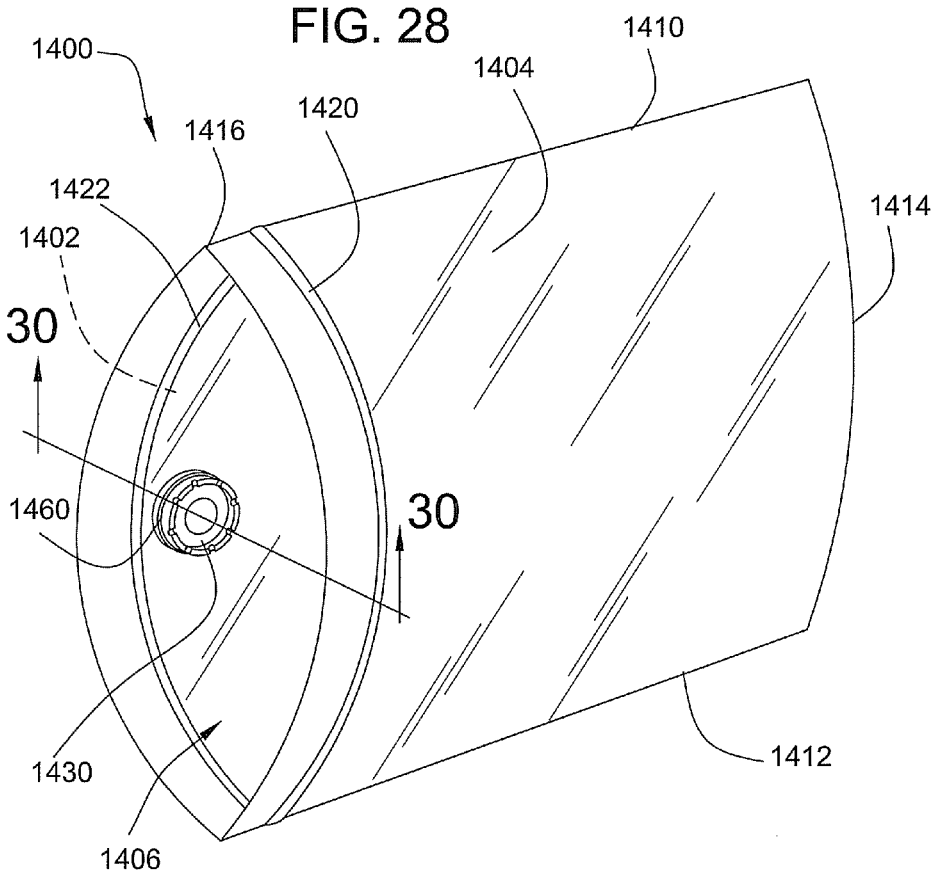
FIG. 28 is a perspective view of a flexible bag having an open top, a one-way valve element, and a clearance member.

An embodiment of the rigid clearance member in the form of a band 1460 engaged to a valve element 1430 attached to a flexible bag 1400 is illustrated in FIG. 28. The flexible bag 1400 is formed from overlapping first and second flexible sidewalls 1402, 1404 that are joined along parallel first and second side edges 1410, 1412 and a closed bottom edge 1414 to define an internal volume 1406. To access the internal volume 1406, the portions of the first and second sidewalls opposite the closed bottom edge 1414 remain unsealed to form an open top edge 1416. To releasably close the open top edge 1416 after insertion of an item, first and second fastening strips 1420, 1422 are provided.

Figure 29:
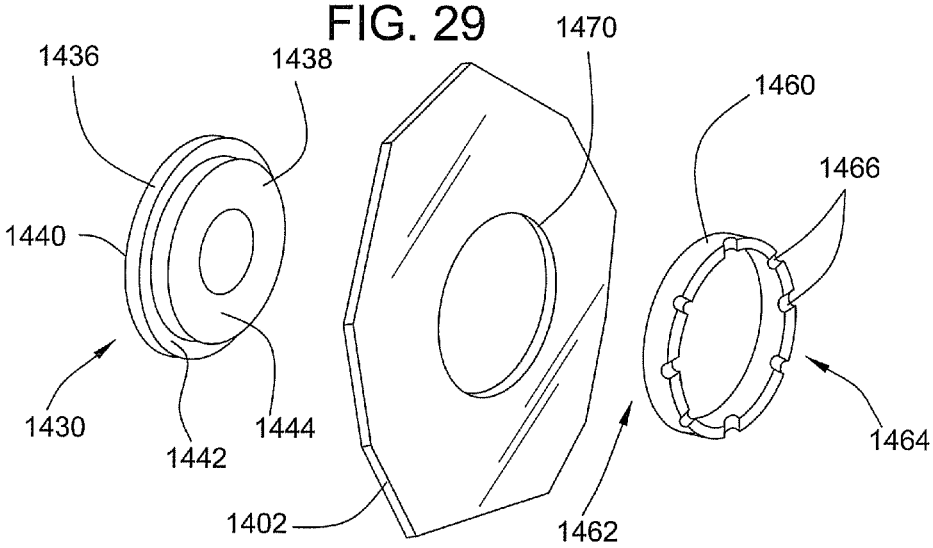
FIG. 29 is an exploded view of the flexible bag, the one-way valve element, and clearance member of FIG. 28.

Referring to FIG. 29, the band 1460 can be shaped as an annular ring having a first face 1462 and an opposing second face 1464. Disposed into the second face 1464 of the annular band 1460 along the perimeter are a plurality of notches 1466 that extend toward the first face 1462. To engage the band 1460 to the valve element 1430, the valve element includes a circular flange portion 1436 from which projects a smaller, circular boss portion 1438. The boss portion 1438 of the valve element 1430 is inserted through an appropriately sized hole 1470 formed into the first sidewall 1402 of the flexible bag. When the valve element 1430 is thus attached, it will be appreciated that the boss portion 1438 projects into the internal volume 1406 towards the second sidewall 1404.

Figure 30:
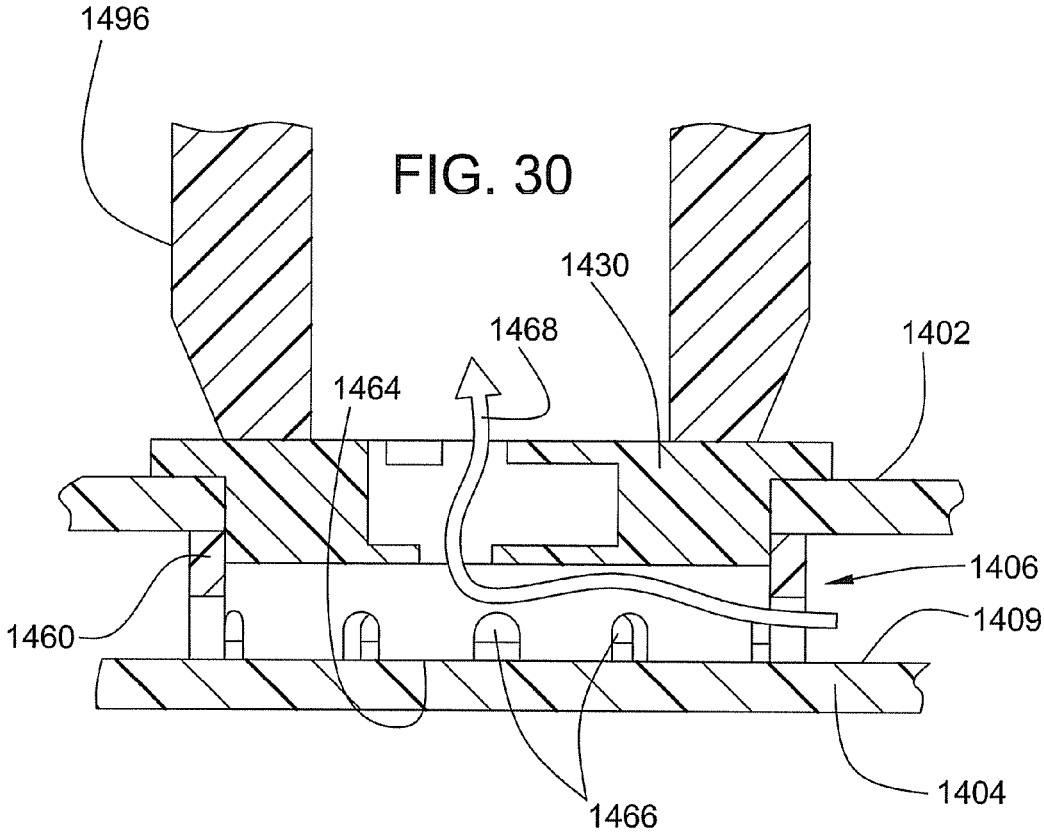
FIG. 30 is a cross-sectional view through the flexible bag, the one-way valve element engaged to a nozzle of a vacuum source, and the clearance member with the sidewalls of the bag collapsed together and a path of flow through the valve element indicated, as taken along lines 30-30 of FIG. 28.

Preferably, the inner diameter of the band 1460 is sized to slidably fit about the circular, projecting boss portion 1438. Accordingly, when the boss portion 1438 and band 1460 are fit together, the first sidewall 1402 is sandwiched between the valve element 1430 and band. So that the second face 1464 of the band 1460 projects into the internal volume, the length of the band between the first and second faces 1462, 1464 is greater than the length of the projecting portion 1438 between the second flange face 1442 and the boss face 1444. In various embodiments, the band and the boss portion can be secured by adhesive, friction fit, or can be an integral portion of the valve As illustrated in FIG. 30, when a nozzle 1496 of a vacuum source is engaged to the valve element 1430 so as to evacuate the flexible bag 1400 such that the second sidewall 1404 collapses toward the first sidewall 1402, the inner surface 1409 of the second sidewall contacts the second face 1464 of the band 1460 and is therefore spaced-apart from the valve element 1430. Air, indicated by arrow 1486, from the internal volume 1406 of the bag 1400 can still access the valve element 1430 through the notches 1466 disposed through the band 1460. Specifically, if the notches 1466 are sufficiently narrow and extend far enough toward the first face 1462 of the band, it will be appreciated that the second sidewall 1404 cannot be completely drawn into the notches. Hence, the valve element 1430 is prevented from clogging by the band 1460. Preferably, the band and the valve element are made of a moldable thermoplastic material.

The vacuum source connected to the nozzle 1496 in FIG. 30 can be any suitable vacuum source including, for example, hand-operated pumps, mechanical pumps, water aspirators, oral suction, and the like. Alternatively, the flexible bag can be evacuated by collapsing the flexible sidewalls together.

Figure 31:
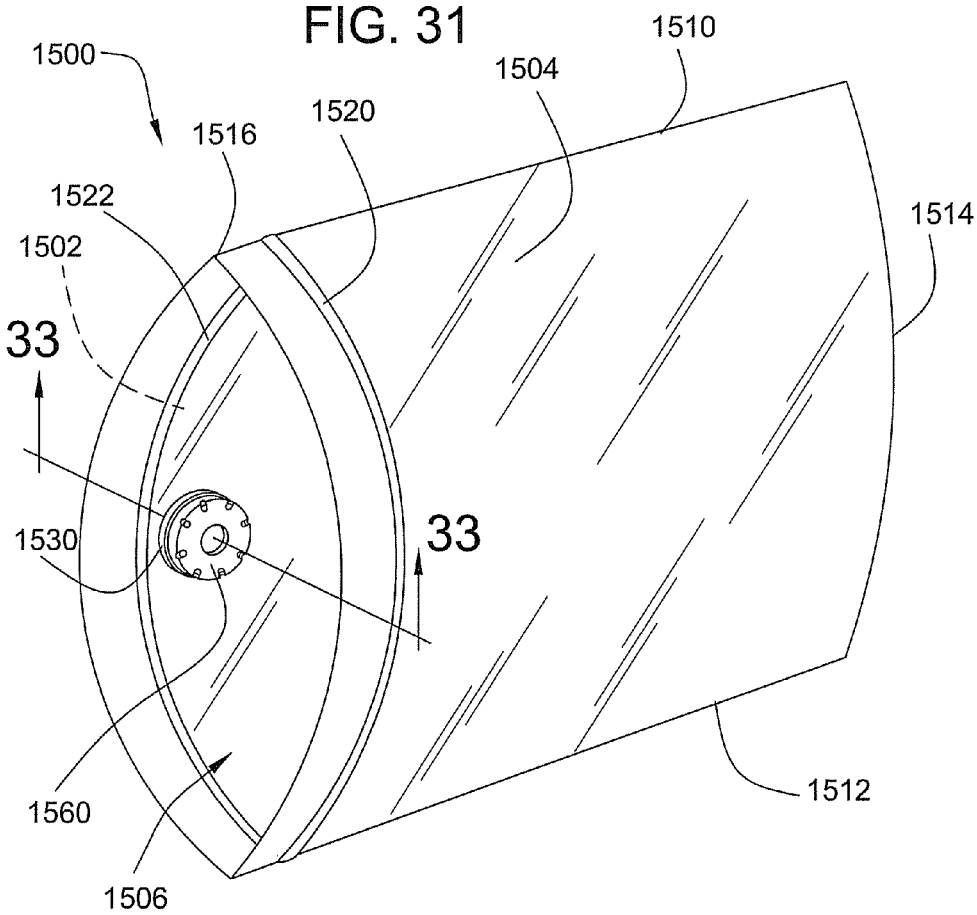
FIG. 31 is a perspective view of a flexible bag having an open top, a one-way valve element, and another embodiment of the clearance member.

In FIG. 31, another embodiment of the rigid clearance member in the form of a cap 1560 is illustrated engaged to a valve element 1530 attached to a flexible bag 1500. As described above, the flexible bag 1500 also includes overlapping first and second sidewalls joined along parallel first and second side edges 1510, 1512 and a perpendicular closed bottom edge 1514 to define an internal volume 1506. To access the internal volume 1506, the portions of the first and second sidewalls 1502, 1504 opposite the closed bottom edge 1514 remain unsealed to form an open top edge 1516. To releasably close the open top edge 1516 after insertion of an item, first and second fastening strips 1520, 1522 are provided.

Figure 32:
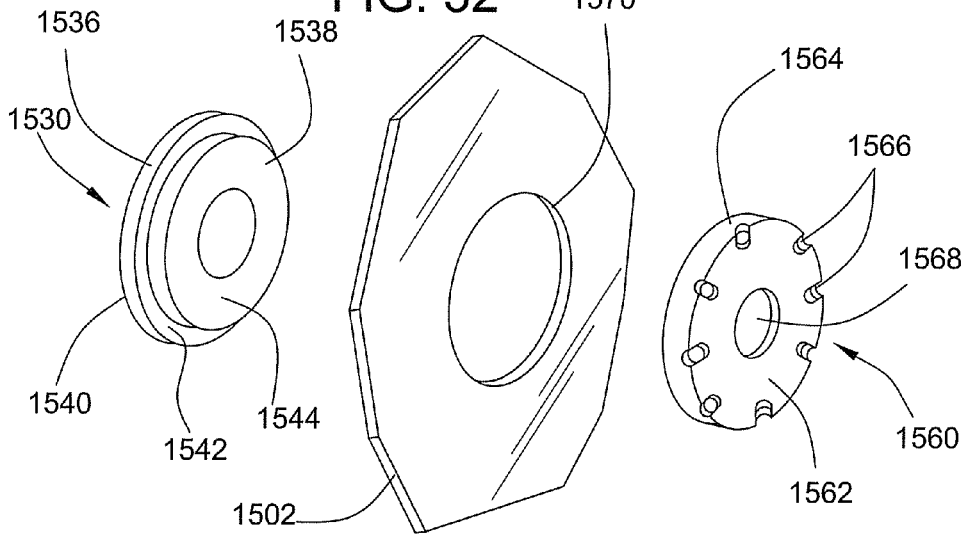
FIG. 32 is an exploded view of the flexible bag, the one-way valve element, and the clearance member of FIG. 31.

Referring to FIG. 32, the cap 1560 includes a circular cap top 1562 from the periphery of which extends a perpendicular cap wall 1564. Disposed through the intersection of the cap top and cap wall are a plurality of peripheral apertures 1566 while disposed through the center of the cap top is a central aperture 1568. To engage the cap 1560 to the valve element 1530, the valve element includes a circular flange portion 1536 from which projects a smaller, circular boss portion 1538. The boss portion 1538 of the valve element 1530 is inserted through an appropriately sized hole 1570 formed into the first sidewall 1502 of the flexible bag. When the valve element 1530 is thus attached, it will be appreciated that the boss portion 1538 projects into the internal volume 1506 towards the second sidewall 1504. Preferably, the inner diameter of the peripheral cap wall 1564 is sized to slidably fit about the circular, projecting boss portion 1538. Accordingly, when the boss portion 1538 and cap wall 1564 are fit together, the first sidewall 1502 is sandwiched between the valve element 1530 and cap 1560. In various embodiments, the cap and the boss portion can be secured together by adhesive, friction fit, or be an integral portion of the valve.

Figure 33:
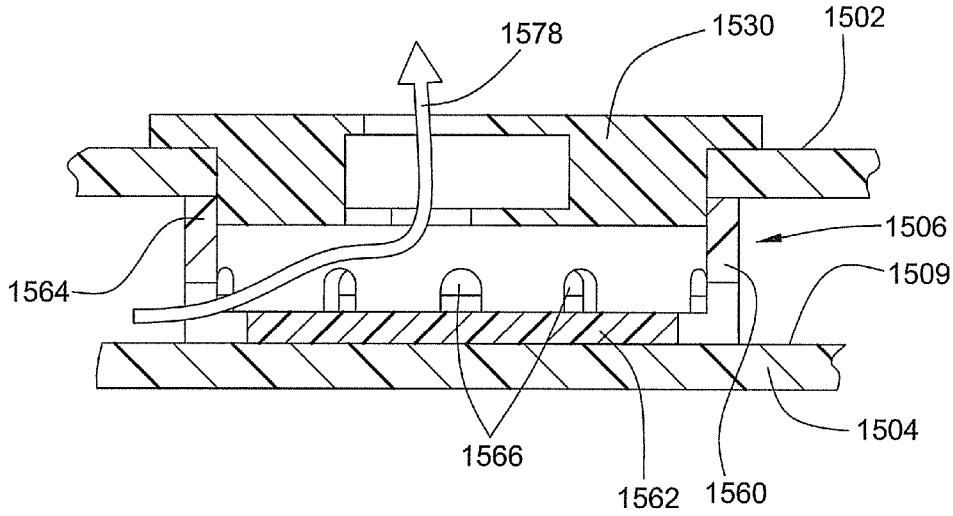
FIG. 33 is a cross-sectional view through the flexible bag, one-way valve element, and the clearance member with the sidewalls of the bag collapsed together and a path of flow through the valve element indicated, as taken along line 33-33 of FIG. 31.

As illustrated in FIG. 33, during evacuation of the flexible bag 1500 as the second sidewall 1504 collapses toward the first sidewall 1502, the inner surface 1509 of the second sidewall contacts the cap top 1562 of the cap 1560 and is therefore spaced-apart from the valve element 1530. In this situation, the central aperture 1568 becomes covered by the second sidewall 1504. Air, indicated by arrow 1578, from the internal volume 1506 of the bag 1500 can still access the valve element 1530 through the peripheral apertures 1566 disposed through the cap 1560. Hence, the valve element 1530 is prevented from clogging by the cap 1560. An advantage of the cap 1560 over the aforementioned band is that cap top 1562 more completely prevents the second sidewall 1504 from collapsing adjacent to the valve element 1530. Additionally, to improve the evacuation of the internal volume 1506, the central aperture 1568 provides substantial additional access to the valve element 1530 than the peripheral apertures 1566 standing alone, at least prior to the central aperture becoming covered by the second sidewall 1504. Preferably, the cap 1560 is made from a moldable thermoplastic material.

Figure 34:
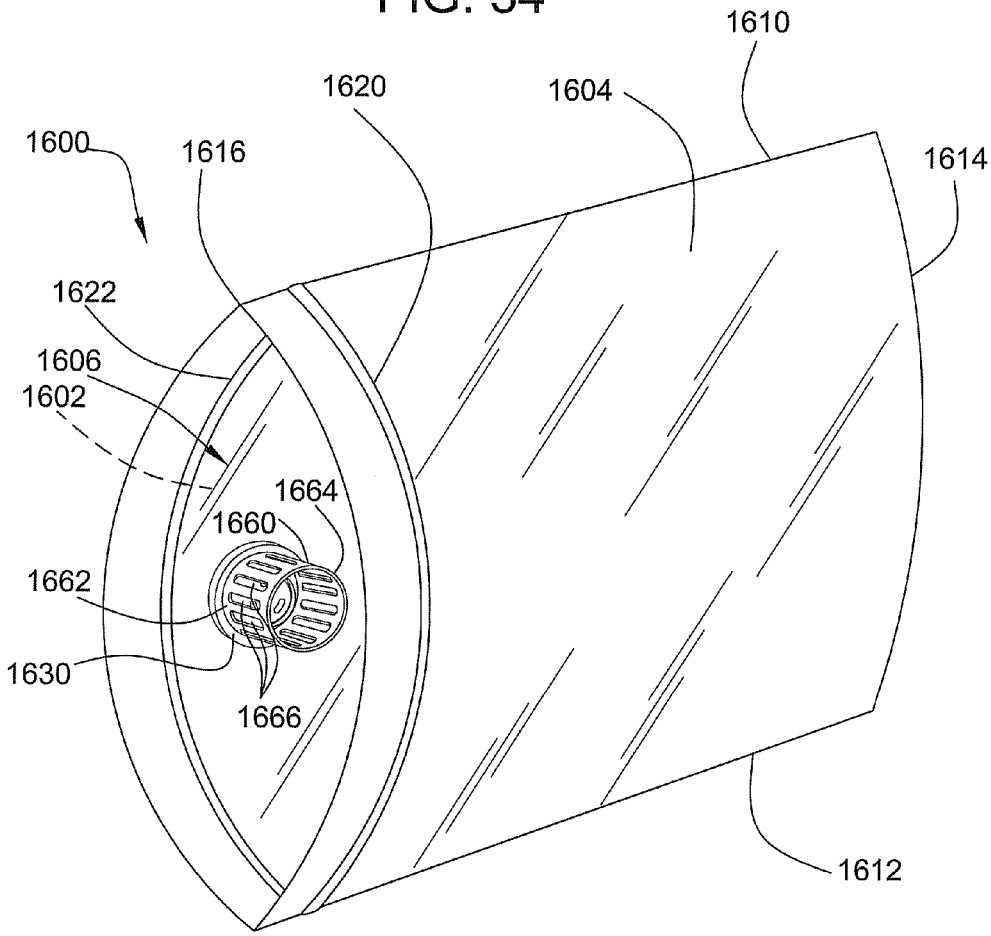
FIG. 34 is a perspective view of a flexible bag having an open top, a one-way valve element, and another embodiment of the clearance member.

Illustrated in FIG. 34 is another embodiment of a rigid clearance member in the form of an elongated sleeve 1660 engaged to a valve element 1630 attached to a flexible bag 1600. As described above, the flexible bag 1600 includes overlapping first and second sidewalls 1602, 1604 that are joined along parallel first and second side edges 1610, 1612 and a perpendicular closed bottom edge 1614 that define an internal volume 1606. To access the internal volume 1606, the portions of the first and second sidewalls 1602, 1604 opposite the closed bottom edge 1614 remain unsealed to form an open top edge 1616. To releasably close the open top edge 1616 after insertion of an item, first and second fastening strips 1620, 1622 are provided.

The elongated sleeve 1660 is formed as a cylindrical structure that extends between a first face 1662 and a second face 1664. Disposed through the sleeve 1660 about the periphery are a plurality of slots 1666. The cylindrical sleeve 1660 can be sized to slideably engage with the circular valve element 1630 in the above described manner with the second face 1664 projecting into the internal volume 1606 towards the second sidewall 1604. Referring to FIG. 34, it will be appreciated that as the first and second sidewalls 1602, 1604 collapse towards each other, the sleeve 1660 will function to space the sidewalls apart in the proximity of the valve element 1630. The slots 1666 disposed through the sleeve 1660, however, will continue to allow air to access the one-way valve element 1630 from the internal volume 1606. Hence, the valve element is prevented from clogging by the sleeve. Preferably, the sleeve is made from a moldable thermoplastic or a formed strip of metal.

Figure 35:
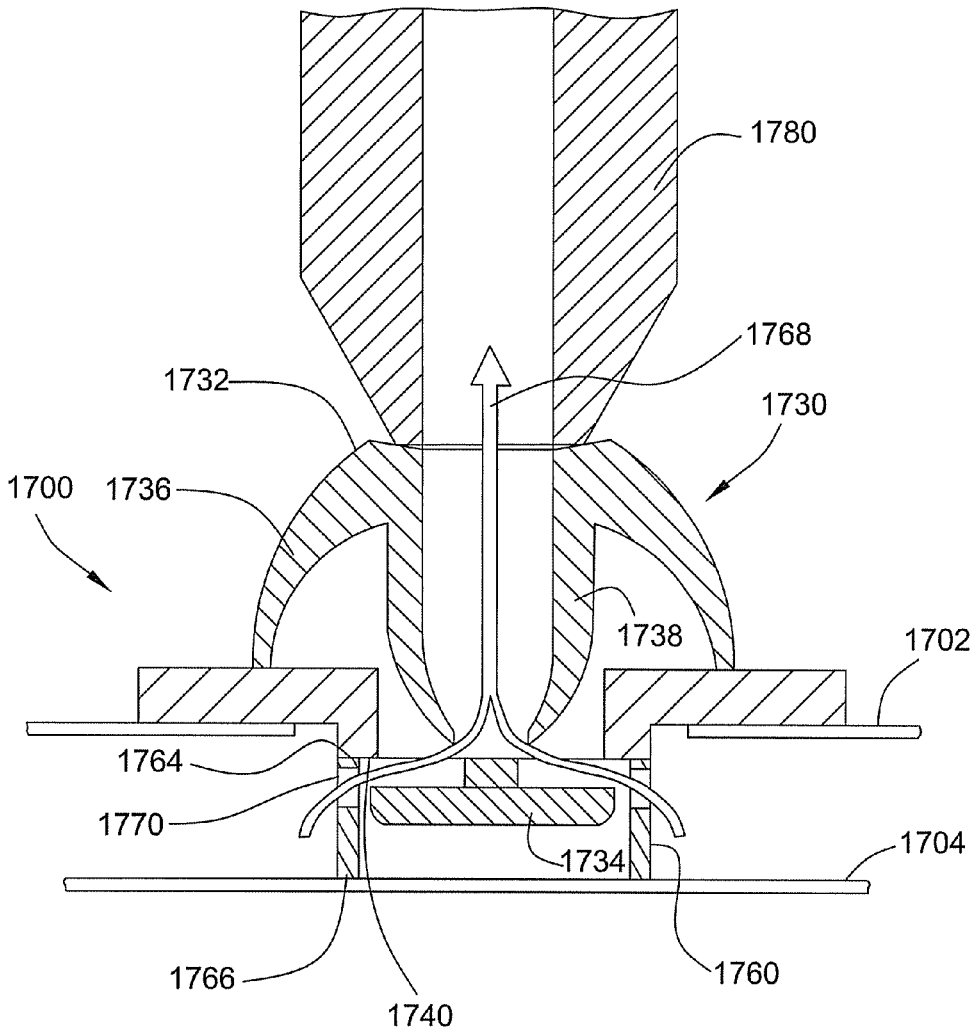
FIG. 35 is a cross-sectional view of a flexible bag having a one-way valve element and a clearance member, the flexible bag being evacuated by a vacuum nozzle with a path of flow indicated.

Illustrated in FIG. 35 is a flexible bag 1700 having attached to it a one-way valve element 1730 of the type disclosed in U.S. Pat. No. 6,581,641, herein incorporated by reference. The flexible bag 1700 also includes a first sidewall 1702 to which the valve element 1730 is attached and an opposing second sidewall 1704. The one-way valve element 1730 includes a resilient cap 1732 that is mounted to a valve base 1734. The resilient cap 1732 includes an outer wall 1736 that surrounds a central stem 1738. The valve element 1730 also includes a valve gate 1734 that normally sits against a valve seat face 1740 that is formed on the valve base 1734. To evacuate the flexible bag 1700, a vacuum nozzle 1780 that communicates with a vacuum source can engage the valve element 1730. The nozzle 1780 engages the valve element 1730 by pressing the nozzle against the outer wall 1736 of the cap 1732. This forces the stem 1738 downwards which displaces the valve gate from the valve seat surface 1740. Air from inside the flexible plastic bag can then access the nozzle.

It will be appreciated that when the nozzle 1780 is pressed against the valve element 1730, the second sidewall 1704 can collapse against and clog the valve element. To prevent this from occurring, an embodiment of the clearance member 1760 is attached to the valve element 1730. The clearance member 1760 is formed as a circular wall extending between a first end 1764 and a second end 1766. The first end 1764 is attached to the valve base 1734 such that the second end 1766 is directed towards the second sidewall 1704. Disposed through the circular wall 1762 are a plurality of apertures 1770 through which air, indicated by arrow 1768, can pass. Accordingly, when the vacuum nozzle 1780 is pressed against the cap 1732, the clearance member 1760 prevents the second sidewall 1704 from entering and clogging the valve element 1730.

In another aspect of the present invention, the clearance element can be provided as compressible structure comprised from a compressible material. The compressible clearance member can be attached to either the valve element or to an inner surface of a sidewall proximate the valve element. Accordingly, the compressible clearance member will prevent the sidewalls from completely collapsing together proximate the valve element. An advantage of utilizing the compressible clearance member is that while the sidewalls remain spaced-apart, the compressible clearance member compresses to minimize the air remaining in the internal volume. Another advantage of utilizing a compressible clearance member is that the compressible clearance member urges back against the sidewalls. Therefore, if the valve element were to become clogged by the sidewalls, the compressible structure could unclog the valve element by urging the first and second sidewalls apart.

Figure 36:
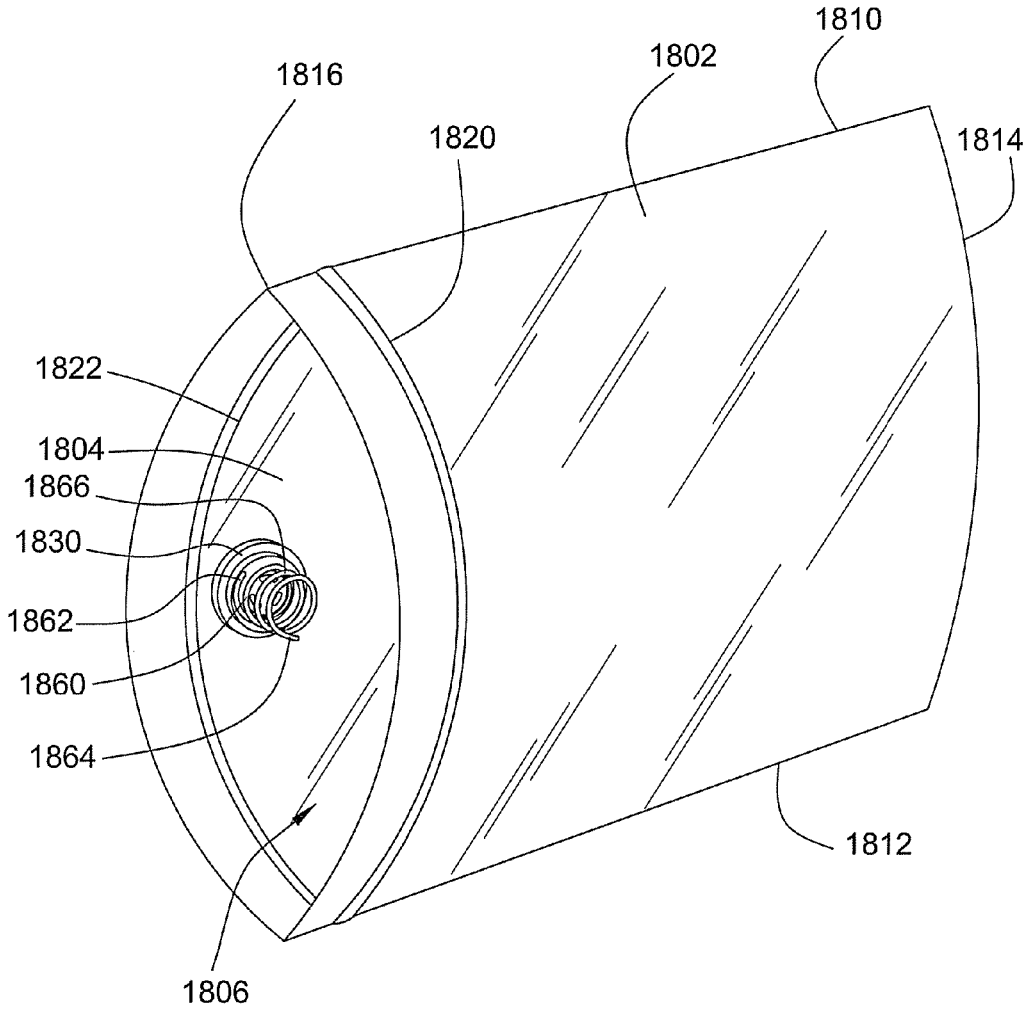
FIG. 36 is a perspective view of a flexible bag having an open top, a one-way valve element, and a compressible clearance member.

Referring to FIG. 36, an embodiment of a flexible bag 1800 having a compressible clearance member in the form of a spring 1860 engaged to a one-way valve element 1830 is illustrated. As described above, the flexible bag 1800 includes overlapping first and second sidewalls 1802, 1804 that are joined along parallel first and second side edges 1810, 1812 and a perpendicular closed bottom edge 1814 that define an internal volume 1806. To access the internal volume 1806, the portions of the first and second sidewalls 1802, 1804 opposite the closed bottom edge 1814 remain unsealed to form an opened top edge 1816. To releasably close the opened top edge 1816 after insertion of an item, first and second fastening strips 1820, 1822 are provided.

The spring 1860 is formed as helical spring comprised of a plurality of hoops 1866 that extends between a first end 1862 and a second end 1864. The first end 1862 engages the valve element 1830 by, for example, adhesive attachment such that the second end 1864 projects into the internal volume 1806 toward the second sidewall 1804. In other embodiments, the spring can be secured to the valve element by a friction fit, a snap-lock engagement, or adhesive. During evacuation, as the first and second sidewalls 1802, 1804 collapse together, the second sidewall 1804 will contact the second end 1864 of the spring 1860 and begin to compress the spring towards the first sidewall. Conversely, the spring 1860 will urge the second sidewall 1804 away from the valve element 1830 preventing the valve element from becoming clogged. Moreover, because of the substantial space between the alternating hoops 1866 of the spring 1860, air will continue to access to the valve element 1830. Preferably, the spring is made from any suitable resilient material such as spring steel or a resilient thermoplastic. In another embodiment, a structure comprising a tube with axially-spaced, collapsible, accordion pleats and holes disposed therethrough can be employed as the compressible clearance member.

Figure 37:
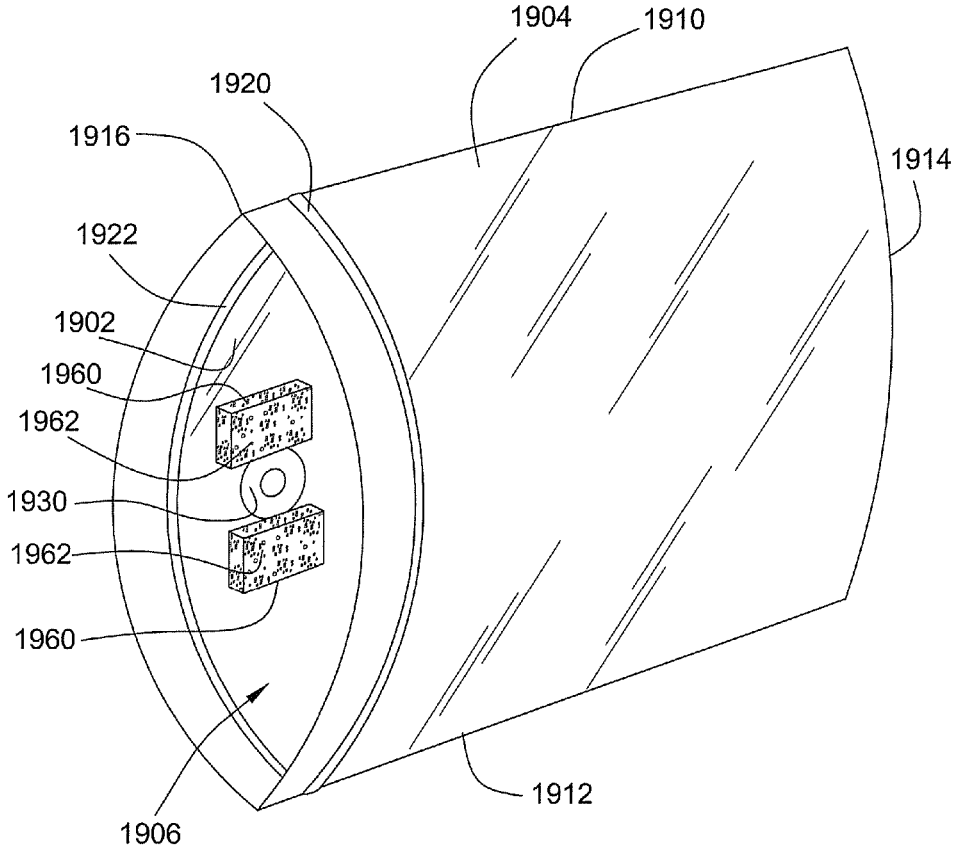
FIG. 37 is a perspective view of a flexible bag having an open top, a one-way valve element and another embodiment of a compressible clearance member.

Illustrated in FIG. 37 is another embodiment of a flexible bag 1900 having a compressible clearance member in the form of compressible foam elements 1960 attached to the flexible bag proximate to a one-way valve element 1930. As described above, the flexible bag 1900 includes overlapping first and second sidewalls 1902, 1904 that are joined along parallel first and second side edges 1910, 1912 and a perpendicular closed bottom edge 1914 that define an internal volume 1906. To access the internal volume 1906, the portions of the first and second sidewalls 1902, 1904 opposite the closed bottom edge 1914 remain unsealed to form an open top edge 1916. To releasably close the open top edge 1916 after insertion of an item, first and second fastening strips 1920, 1922 are provided.

The compressible foam elements 1960 are shaped as rectangular blocks of porous foam attached to the inner surface of the first sidewall 1902 on either side of valve element 1930. However, in other embodiments, the foam elements can be attached to the second sidewall in a manner to align with the valve element. Additionally, in other embodiments, the foam element can have other shapes, such as circular, square, annular, or polygon The foam elements 1960 extend into the internal volume 1906 and terminate at respective foam top surfaces 1962 that are located closer toward the second sidewall 1904 than the valve element 1930. During evacuation, as the first and second sidewalls 1902, 1904 collapse towards each other, the second sidewall will contact the foam top surfaces 1962 and begin to compress the foam blocks 1960 towards the first sidewall 1902. Conversely, the foam blocks 1960 will urge the second sidewall 1904 away from the valve element 1930 preventing the valve element from clogging. Because of the porous character of the foam blocks 1960, air will continue to have access to the valve element. Preferably, the foam blocks are formed from foamed rubber.

Figure 38:
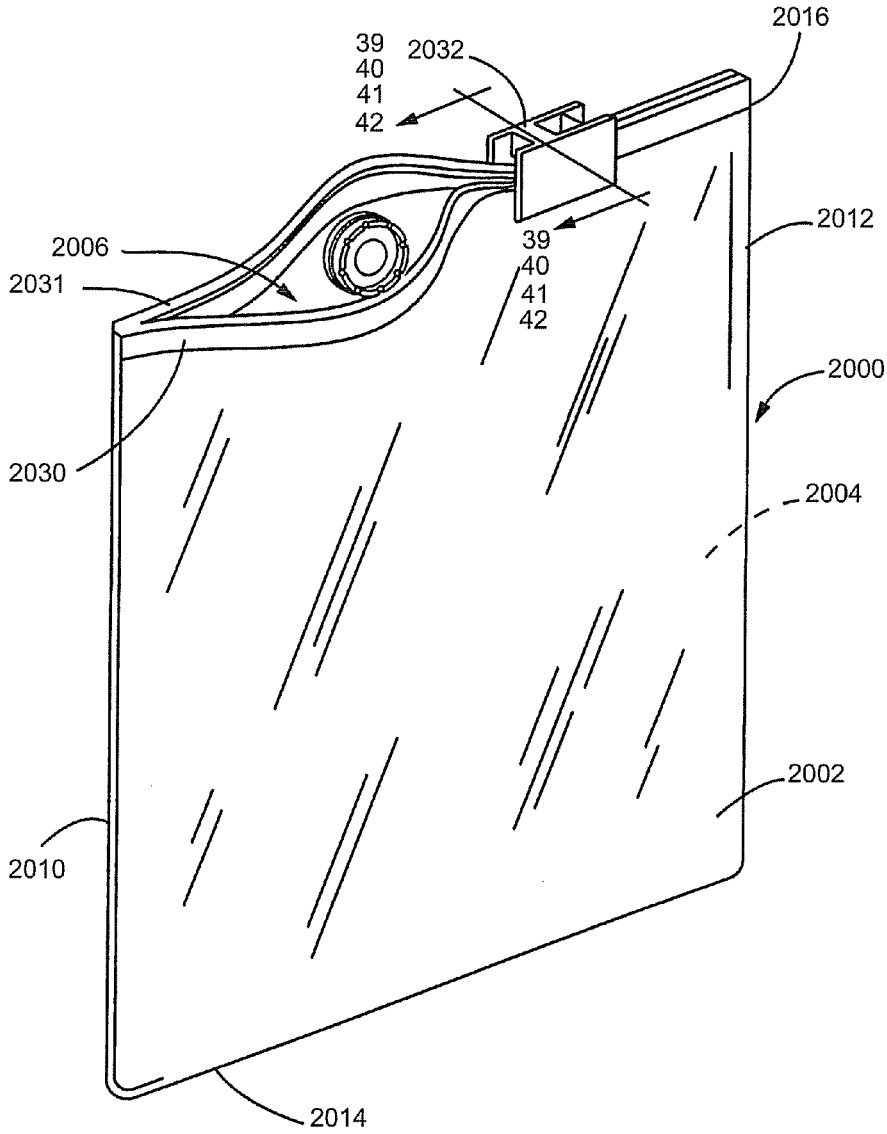
FIG. 38 is a perspective view of a flexible bag having a closable open top with interlocking fastener strips and a slider, a one-way valve element and an embodiment of the clearance member.

In another aspect of the invention, the flexible bag having a one-way valve element and clearance member can be provided with fastening strips activated by a slider. For example, referring to FIG. 38, there is illustrated a flexible bag 2000 having overlapping first and second sidewalls that are joined along parallel first and second side edges 2010, 2012, and a perpendicular closed bottom edge 2014 to define an internal volume 2006. To access the internal volume 2006, the portions of the first and second sidewalls 2002, 2004 that are opposite the closed bottom edge 2014 remain unjoined to form an open top edge 2016. To releasably close the open top edge 2016, the flexible bag 2000 includes a first fastening strip 2030 and a second fastening strip 2031 that engage a movable slider 2032.

Figure 39:
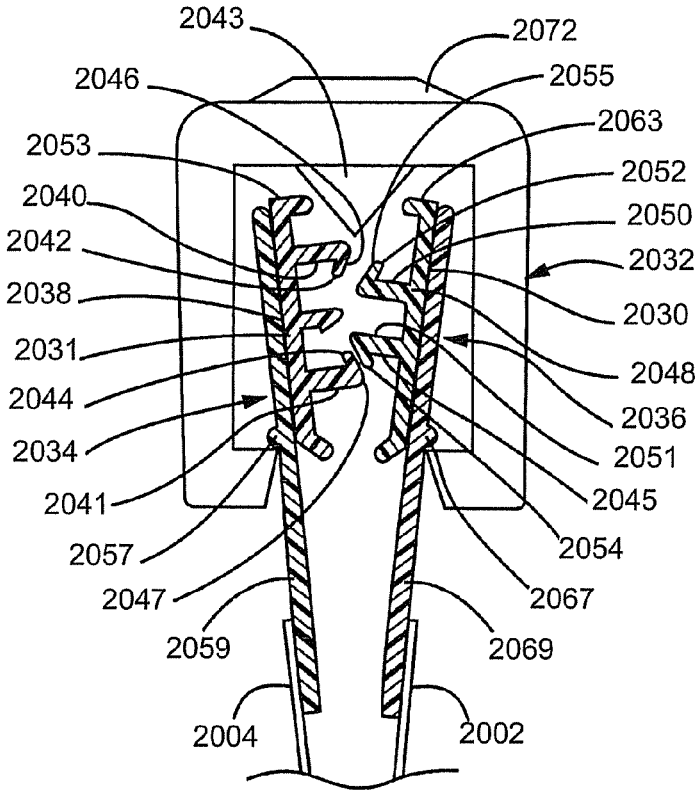
FIG. 39 is a cross-sectional view of the interlocking fasteners strips engaging a movable slider for releasably closing the opened top, as taken along line 39-39 of FIG. 38.

As shown in FIG. 39, the fastening strips may be U-channel fastening strips as described in U.S. Pat. No. 4,829,641, herein incorporated by reference in its entirety. U-channel fastening strips include a first fastening strip 2030 with a first closure element 2036 and a second fastening strip 2031 with a second closure element 2034. The first closure element 2036 engages the second closure element 2034. The first fastening strip 2030 may include a flange 2063 disposed at the upper end of the first fastening strip 2030 and a rib 2067 disposed at the lower end of the first fastening strip 2030. The first fastening strip 2030 may include a flange portion 2069. Likewise, the second fastening strip 2031 may include a flange 2053 disposed at the upper end of the second fastening strip 2031 and a rib 2057 disposed at the lower end of the second fastening strip 2031. The second fastening strip 2031 may include a flange portion 2059. The sidewalls 2002, 2004 of the plastic bag 2000 may be attached to the fastening strips 2030, 2031 by conventional manufacturing techniques.

The second closure element 2034 includes a base portion 2038 having a pair of spaced-apart parallely disposed webs 2040, 2041, extending from the base portion 2038. The base and the webs form a U-channel closure element. The webs 2040, include hook closure portions 2042, 2044 extending from the webs 2040, 2041 respectively, and facing towards each other. The hook closure portions 2042, 2044 include guide surfaces 2046, 2047 which serve to guide the hook closure portions 2042, 2044 for occluding with the hook closure portions 2052, 2054 of the first closure element 2036.

The first closure element 2036 includes a base portion 2048 including a pair of spaced-apart, parallely disposed webs 2050, 2051 extending from the base portion 2048. The base and the webs form a U-channel closure element. The webs 2050, 2051 include hook closure portions 2052, 2054 extending from the webs 2050, 2051 respectively and facing away from each other. The hook closure portions 2052, 2054 include guide surfaces 2045, 2055, which generally serve to guide the hook closure portions 2052, 2054 for occlusion with the hook closure portions 2042, 2044 of the second closure element 2034. The guide surfaces 2045, 2055 may also have a rounded crown surface.

The slider 2032 includes a top portion 2072. The top portion provides a separator 2043 having a first end and a second end wherein the first end may be wider than the second end. In addition, the separator 2043 may be triangular in shape. When the slider is moved in the occlusion direction, the separator 2043 deoccludes the fastening strips 2030, 2031. When the closure elements 2034, 2036 are deoccluded, the upper hook portions 2042, 2052 and the lower hook portions 2044, 2054 are deoccluded.

Figure 40:
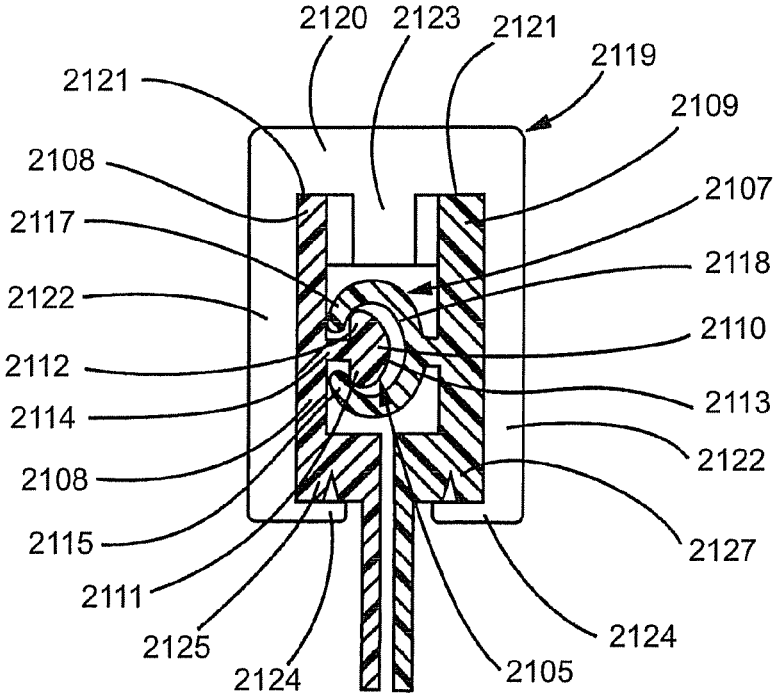
FIG. 40 is a cross-sectional view of another embodiment of the interlocking fastener strips engaging a movable slider for releasably closing the opened top, as taken along line 40-40 of FIG. 38.

The interlocking fastening strips may comprise "arrowhead-type" or "rib and groove" fastening strips as shown in FIG. 40 and as described in U.S. Pat. 3,806,998 herein incorporated by reference in its entirety. The rib element 2105 interlocks with the groove element 2107. The rib element 2105 is of generally arrow-shape in transverse cross section including a head 2110 comprising interlock shoulder hook portions 2111 and 2112 generally convergently related to provide a cam ridge 2113 generally aligned with a stem flange 2114 by which the head is connected in spaced relation with respect to the supporting flange portion 2108. (U.S. Pat. No. 3,806,998, Col. 2, lines 16-23). At their surfaces nearest the connecting stem flange 2114, the shoulder portions 2111 and 2112 define reentrant angles therewith providing interlock hooks engageable with interlock hook flanges 2115 and 2117 respectively of the groove element 2107. (U.S. Pat. No. 3,806, 998, Col. 2, lines 23-28). Said hook flanges generally converge toward one another and are spread open to receive the head 2110 therebetween when said head is pressed into said groove element 2107 until the head is fully received in a groove 2118 of said groove element 2107 generally complementary to the head and within which the head is interlocked by interengagement of the head shoulder hook portions 2111 and 2112 and the groove hook flanges 2115 and 2117. (U.S. Pat. No. 3,806,998, Col. 2, lines 28-36). Through this arrangement, as indicated, the head and groove elements 2105 and 2107 are adapted to be interlockingly engaged by being pressed together and to be separated when forcably pulled apart, as by means of a generally U-shaped slider 2119. (U.S. Pat. No. 3,806,998, Col. 2, lines 36-41).

The slider 2119 includes a flat back plate 2120 adapted to run along free edges 2121 on the upper ends of the sections of the flange portions 2108 and 2109 as shown in the drawing. (U.S. Pat. No. 3,806,998, Col. 2, lines 41-46). Integrally formed with the back plate 2120 and extending in the same direction (downwardly as shown) therefrom are respective coextensive sidewalls 2122 with an intermediate spreader finger 2123 extending in the same direction as the sidewalls at one end of the slider. (U.S. Pat. No. 3,806,998, Col. 2, lines 46-51). The sidewalls 2122 are in the form of panels which are laterally divergent from a narrower end of the slider. (U.S. Pat. No. 3,806,998, Col. 2, lines 51-55). The slider walls 2122 are each provided with an inwardly projecting shoulder structure 2124 flange adapted to engage respective shoulder ribs 2125 and 2127 on respectively outer sides of the lower section of the flange portions 2108 and 2109. (U.S. Pat. No. 3,806, 998, Col. 2, line 66 to Col. 3, line 3).

Figure 41:
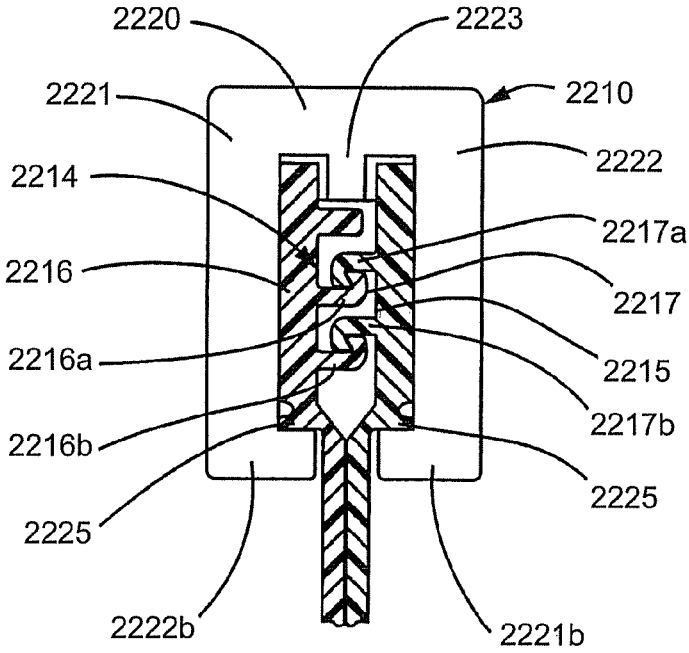
FIG. 41 is a cross-sectional view of another embodiment of the interlocking fastener strips engaging a movable slider for releasably closing the opened top, as taken along line 41-41 of FIG. 38.

Additionally, the interlocking fastening strips may comprise "profile" fastening strips, as shown in FIG. 41 and described in U.S. Pat. No. 5,664,299 herein incorporated by reference in its entirety. As shown in FIG. 41, the first profile 2216 has at least an uppermost closure element 2216*a* and a bottommost closure element 2216*b*. (U.S. Pat. No. 5,664,299, Col. 3, lines 25-27). The closure elements 2216*a* and 2216*b* project laterally from the inner surface of strip 2214. (U.S. Pat. No. 5,664,299, Col. 3, lines 27-28). Likewise, the second profile 2217 has at least an uppermost closure element 2217*a* and a bottommost closure element 2217*b*. (U.S. Pat. No. 5,664,299, Col. 3, lines 28-30). The closure elements 2217*a* and 2217*b* project laterally from the inner surface of strip 2215. (U.S. Pat. No. 5,664,299, Col. 3, lines 30-32). When the bag is closed, the closure elements of profile 2216 interlock with the corresponding closure elements of profile 2217. (U.S. Pat. No. 5,664,299, Col. 3, lines 32-34). As shown in FIG. 41, closure elements 2216*a*, 2216*b*, 2217*a* and 2217*b* have hooks on the ends of the closure elements, so that the profiles remain interlocked when the bag is closed, thereby forming a seal. (U.S. Pat. No. 5,664,299, Col. 3, lines 34-37).

The straddling slider 2210 comprises an inverted U-shaped member having a top 2220 for moving along the top edges of the strips 2214 and 2215. (U.S. Pat. No. 5,664,299, Col. 4, lines 1-3). The slider 2210 has sidewalls 2221 and 2222 depending from the top 2220. (U.S. Pat. No. 5,664,299, Col. 4, lines 3-4). A separating leg 2223 depends from the top 2220 between the sidewalls 2221 and 2222 and is located between the uppermost closure elements 2216*a* and 2217*a* of profiles 2216 and 2217. (U.S. Pat. No. 5,664,299, Col. 4, lines 26-30). The fastening assembly includes ridges 2225 on the outer surfaces of the fastening strips 2214 and 2215, and shoulders 2221*b* and 2222*b* on the sidewalls of the slider. (U.S. Pat. No. 5,664,299, Col. 4, lines 62-65). The shoulders act as means for maintaining the slider in straddling relation with the fastening strips by grasping the lower surfaces of the ridges 2225. (U.S. Pat. No. 5,664,299, Col. 5, lines 4-7).

Figure 42:
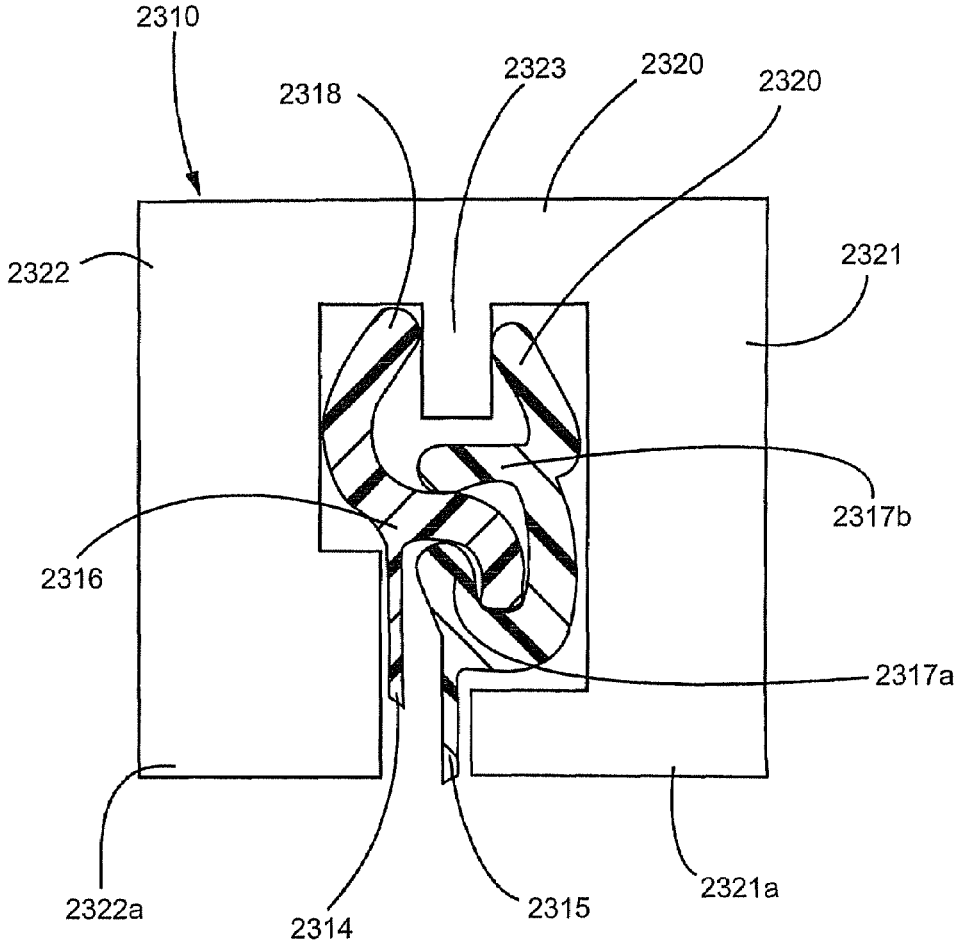
FIG. 42 is a cross-sectional view of another embodiment of the interlocking fastener strips engaging a movable slider for releasably closing the opened top, as taken along line 42-42 of FIG. 38.

Also, the interlocking fastening strips may be "rolling action" fastening strips as shown in FIG. 42 and described in U.S. Pat. No. 5,007,143 herein incorporated by reference in its entirety. The strips 2314 and 2315 include profiled tracks 2318 and 2319 extending along the length thereof parallel to the rib and groove elements 2316 and 2317 and the rib and groove elements 2316, 2317 have complimentary cross-sectional shapes such that they are closed by pressing the bottom of the elements together first and then rolling the elements to a closed position toward the top thereof. (U.S. Pat. No. 5,007, 143, Col. 4, line 62 to Col. 5, line 1). The rib element 2316 is hook shaped and projects from the inner face of strip 2314. (U.S. Pat. No. 5,007,143, Col. 5, lines 1-3). The groove element 2317 includes a lower hook-shaped projection 2317*a* and a relatively straight projection 2317*b* which extend from the inner face of strip 2315. (U.S. Pat. No. 5,007,143, Col. 5, lines 3-6). The profiled tracks 2318 and 2319 are inclined inwardly toward each other from their respective strips 2314 and 2315. (U.S. Pat. No. 5,007,143, Col. 5, lines 6-8).

The straddling slider 2310 comprises an inverted U-shaped plastic member having a back 2320 for moving along the top edges of the tracks 2318 and 2319 with sidewalls 2321 and 2322 depending therefrom for cooperating with the tracks and extending from an opening end of the slider to a closing end. (U.S. Pat. No. 5,007,143, Col. 5, lines 26-31). A separator finger 2323 depends from the back 2320 between the sidewalls 2321 and 2322 and is inserted between the inclined tracks 2318 and 2319. (U.S. Pat. No. 5,007,143, Col. 5, lines 34-36). The slider 2310 has shoulders 2321*a* and 2322*a* projecting inwardly from the depending sidewalls 2321 and 2322 which are shaped throughout the length thereof for cooperation with the depending separator finger 2323 in creating the rolling action in opening and closing the reclosable interlocking rib and groove profile elements 2316 and 2317. (U.S. Pat. No. 5,007,143, Col. 5, lines 43-49).

In other embodiments, the fastening strips noted above may also be used without the slider.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flexible bag comprising:

a first sidewall;

a second sidewall overlaying and joined to the first sidewall to provide an internal volume between the opposing first and second inner surfaces of the respective first and second sidewalls;

at least one inner surface having a first textured portion and a second textured portion, wherein each first and second textured portion comprises a plurality of protuberances with recessed passageways therebetween, the aggregate volumetric capacity per unit area of the first recessed passageways of the first textured portion being less than the aggregate volumetric capacity per unit area of the of the second recessed passageways of the second textured portion;

a one-way valve element attached to one of the first sidewall and the second sidewall, the valve element communicating with the interior volume, the second textured portion is spaced apart from the valve element and the first textured portion is positioned closer to the valve element than the second textured portion, wherein the one-way valve element is configured to allow air to pass out of the bag but prevents air from entering the bag; and wherein the total number of recessed passageways of the first textured portion is fewer than the total number of recessed passageways of the second textured portion; and during evacuation of the internal volume, evacuating air experiences an increased resistance to flow as it moves through the recessed passageways of the first textured portion thereby causing entrained liquids in the evacuating air to condense or drop out of the air prior to accessing the valve element.

2. The flexible bag of claim 1, wherein the first and second recessed passageways are groove passageways.

3. The flexible bag of claim 1, wherein the first and second textured portions are included on the inner surface of the second sidewall opposite the valve element.

4. The flexible bag of claim 1, wherein the first and second protuberances are square in shape.

5. The flexible bag of claim 1, wherein the first and second protuberances are circular in shape.

6. The flexible storage bag of claim 1 further comprising a clearance member proximate the valve element.

7. A flexible storage bag comprising:

a first sidewall;

a second sidewall overlying and joined to the first sidewall along a first side edge, a parallel second side edge, and a bottom edge extending between the first and second side edges, the first and second sidewalls thereby providing an interior volume accessible through an open top edge parallel to the bottom edge;

the first sidewall including a first inner surface having a first textured portion and a second textured portion, wherein the first textured portion includes a first plurality of groove passageways and the second textured portion includes a second plurality of groove passageways communicating with the first plurality of groove passageways, wherein aggregate volumetric capacity per unit area of the first plurality of groove passageways is less than the aggregate volumetric capacity per unit area of second plurality of groove passageways;

a one-way valve element communicating with the interior volume, the second textured portion is spaced apart from the valve element and the first textured portion is positioned closer to the valve element than the second textured portion, wherein the one-way valve element is configured to allow air to pass out of the bag but prevents air from entering the bag;

wherein during evacuation of the internal volume, evacuating air experiences an increased resistance to flow as it moves through the recessed passageways of the first textured portion thereby causing entrained liquids in the evacuating air to condense or drop out of the air prior to accessing the valve element; and wherein the first plurality of groove passages have a first depth, and the second plurality of groove passageways have a second depth, the first depth less than the second depth.

8. The flexible storage bag of claim 7, wherein the first depth is 0.0003 inches and the second depth is 0.010 inches.

9. A flexible storage bag comprising:

a first sidewall;

a second sidewall overlying and joined to the first sidewall along a first side edge, a parallel second side edge, and a bottom edge extending between the first and second side edges, the first and second sidewalls thereby providing an interior volume accessible through an open top edge parallel to the bottom edge;

the first sidewall including a first inner surface having a first textured portion and a second textured portion, wherein the first textured portion includes a first plurality of groove passageways and the second textured portion includes a second plurality of groove passageways communicating with the first plurality of groove passageways, wherein aggregate volumetric capacity per unit area of the first plurality of groove passageways is less than the aggregate volumetric capacity per unit area of second plurality of groove passageways;

a one-way valve element communicating with the interior volume, the second textured portion is spaced apart from the valve element and the first textured portion is positioned closer to the valve element than the second textured portion, wherein the one-way valve element is configured to allow air to pass out of the bag but prevents air from entering the bag; and wherein the total number of grooves in the first plurality is fewer than the total number of grooves in the second plurality.

10. The flexible storage bag of claim 9, wherein the first and second pluralities of groove passageways are curvilinear.

11. The flexible storage bag of claim 9, wherein the first and second pluralities of groove passageways are linear.

12. A flexible storage bag comprising:

a first sidewall;

a second sidewall overlying and joined to the first sidewall along a first side edge, a parallel second side edge, and a bottom edge extending between the first and second side edges, the first and second sidewalls thereby providing an interior volume accessible through an open top edge that is parallel to the bottom edge;

the first sidewall including a plurality of grooves arranged in a pattern extending from the bottom edge to the open top edge, wherein aggregate volumetric capacity per unit area decreases as the pattern extends from the bottom edge to the open top edge;

a one-way valve element aft ached to one of the first side wall and the second sidewall and disposed adjacent the top edge, the one-way valve element communicating with the interior volume; and wherein the total number of grooves in a region nearer the top edge is fewer than the total number of grooves in a region nearer the bottom edge; and wherein during evacuation of the interior volume, evacuating air experiences an increased resistance to flow as it moves through the grooves in a direction towards the top edge thereby causing entrained liquids in the evacuating air to condense or drop out of the air prior to accessing the valve element.

13. The flexible storage bag of claim 12, wherein the plurality of groove passageways are arranged in a radial pattern.

14. The flexible storage bag of claim 13, wherein the first sidewall further comprises a second plurality of groove passageways, the second plurality intersecting with the first plurality.

15. The flexible storage bag of claim 14, wherein the second plurality of groove passageways are arranged in a concentric pattern.

* * * * *